US009085136B2

(12) United States Patent
Yatsunami

(10) Patent No.: US 9,085,136 B2
(45) Date of Patent: Jul. 21, 2015

(54) LIQUID EJECTING APPARATUS AND METHOD FOR DETECTING MEDIUM EDGE POSITION IN LIQUID EJECTING APPARATUS

(71) Applicant: SEIKO EPSON CORPORATION, Tokyo (JP)

(72) Inventor: Tetsuji Yatsunami, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 52 days.

(21) Appl. No.: 13/780,558

(22) Filed: Feb. 28, 2013

(65) Prior Publication Data

US 2013/0229454 A1 Sep. 5, 2013

(30) Foreign Application Priority Data

Mar. 1, 2012 (JP) ..... 2012-045691

(51) Int. Cl.

| | |
|---|---|
| ***B41J 29/38*** | (2006.01) |
| ***B41J 2/045*** | (2006.01) |
| ***B41J 11/00*** | (2006.01) |
| ***B41J 19/20*** | (2006.01) |

(52) U.S. Cl.

CPC ..... *B41J 2/04556* (2013.01); *B41J 11/0095* (2013.01); *B41J 19/202* (2013.01)

(58) Field of Classification Search

CPC .... B41J 2/0458; B41J 2/04563; B41J 29/393; B41J 2/04591; B41J 2/04581

USPC ..... 347/14

See application file for complete search history.

(56) References Cited

U.S. PATENT DOCUMENTS

| | | | | |
|---|---|---|---|---|
| 2009/0122098 | A1* | 5/2009 | Shindo | 347/17 |
| 2011/0002702 | A1* | 1/2011 | Niijima | 399/44 |

FOREIGN PATENT DOCUMENTS

| | | | | |
|---|---|---|---|---|
| JP | 2002-127521 | * | 5/2002 | B41J 11/42 |
| JP | 2002-127521 | A | 5/2002 | |
| JP | 2003-260829 | A | 9/2003 | |
| JP | 2004-314410 | A | 11/2004 | |
| JP | 2007-098760 | A | 4/2007 | |
| JP | 2007-276135 | * | 10/2007 | B41J 2/01 |
| JP | 2007-276135 | A | 10/2007 | |
| JP | 2010-194748 | A | 9/2010 | |

* cited by examiner

*Primary Examiner* — Manish S Shah
*Assistant Examiner* — Yaovi Ameh
(74) *Attorney, Agent, or Firm* — Global IP Counselors, LLP

(57) ABSTRACT

A liquid ejecting apparatus and a method for detecting a medium edge position are provided wherein the edge position of the medium can be comparatively more accurately detected even when the sensitivity of an optical sensor has changed due to fouling or the like.

10 Claims, 10 Drawing Sheets

| | FIRST EDGE | SECOND EDGE |
|---|---|---|
| CORRECTION AMOUNT dx (mm) | dx1 (-0.3) | dx2 (0.5) |

CD

LIQUID EJECTING APPARATUS AND METHOD FOR DETECTING MEDIUM EDGE POSITION IN LIQUID EJECTING APPARATUS

CROSS-REFERENCE TO RELATED APPLICATIONS

This application claims priority to Japanese Patent Application No. 2012-045691 filed on Mar. 1, 2012. The entire disclosure of Japanese Patent Application No. 2012-045691 is hereby incorporated herein by reference.

BACKGROUND

1. Technical Field

The present invention relates to a liquid ejecting apparatus provided with a liquid ejecting head for ejecting a liquid onto a medium such as a sheet of paper and a light reflection optical sensor for detecting an edge position of the medium, and also relates to a method for detecting a medium edge position in a liquid ejecting apparatus.

2. Background Technology

An ink jet printer has been known as one example of this kind of liquid ejecting apparatus. Provided to the printer is a carriage which moves in a movement direction (main scanning direction) intersecting with a conveyance direction for sheets of paper, and which has a liquid ejecting head (a recording head). During printing, ink droplets are ejected from the liquid ejecting head toward a sheet of paper while the carriage is being moved, whereby an image or the like is printed onto the sheet of paper (for example, Patent Documents 1-4, etc.).

In, for example, the printers described in Patent Documents 1-4, a light reflection optical sensor (an edge sensor) was provided to the carriage, and a widthwise edge position of the sheet of paper was detected by the optical sensor while the carriage was being moved in the movement direction. More specifically, a detection value from the optical sensor and a threshold value are compared against each other, and when the detection value changes to being the threshold value or lower or to being the threshold value or higher, the current sensor position is determined to be an edge detection position (edge position) of the sheet of paper.

It has been noted that an ink mist generated when the liquid ejecting head ejected the ink droplets was present in the vicinity of a movement path of the carriage, as was suspended matter such as paper dust generated from the sheet of paper due to sliding over a conveyor roller, or the like. When the suspended matter sticks and the optical sensor is sullied, there is a gradual reduction in the amount of light received thereby, whereupon this has resulted in changes to a correction amount used in order to correct for an amount of positional deviation between the edge detection position at which the edge position of the sheet of paper was detected and the actual edge position of the sheet of paper, i.e., to correct by an amount commensurate with this amount of positional deviation. In order to resolve this, in a printer apparatus described in Patent Document 1, a threshold value that is optimal for every iteration is re-determined for every iteration of printing, and thus it is possible to detect the edge position with high positional accuracy by using a threshold value that is optimal and has not been impacted even by aging changes in the surface state of a support base nor by aging changes caused by fouling of the optical sensor.

In printers described in Patent Documents 2 and 3, a rib of a support base and a portion other than the rib (a groove part) are detected by an optical sensor (a recording sheet detection sensor), a detection sensitivity of the optical sensor is determined on the basis of a comparison (ratio or difference) between respective detection voltages (output values), and a threshold value corresponding to the detection sensitivity is set. For this reason, there will be a constant amount of positional deviation between the edge detection position of when the detection value of the optical sensor crosses over the threshold value and the actual edge position, and thus the edge position can be detected at high positional accuracy when corrected with a constant correction amount corresponding to the amount of positional deviation thereof.

In Patent Document 4, the printer is provided with an optical sensor for detecting a sheet of paper and a loading part and for outputting an output signal for the respectively different output values, and with a linear encoder for detecting the position of a print head in a movement direction; the output values at a timing where the level of the detection signal of the linear encoder is switched are acquired and an approximation function indicative of the relationship between the output values and the position of the print head is calculated. A controller calculates a point of intersection where the approximation function intersects with a threshold value of the output values, and understands the position of the point of intersection to be the edge position of the paper.

Japanese Laid-open Patent Publication No. 2002-127521 (for example, paragraphs [0037]-[0052], FIG. 4, FIG. 5, etc.) (Patent Document 1), Japanese Laid-open Patent Publication No. Publication 2003-260829 (for example, paragraphs [0053]-[0059], FIG. 5, FIG. 6, etc.), Japanese Laid-open Patent Publication No. 2010-194748 (for example, paragraphs [0046]-[0050], FIG. 5, etc.) (Patent Document 3), and Japanese Laid-open Patent Publication No. 2007-276135 (for example, paragraphs [0072]-[0081], FIG. 5, FIG. 8, etc.) (Patent Document 4) are examples of the related art.

SUMMARY

Problems to Be Solved by the Invention

It has been noted that in Patent Documents 2 and 3, the rib of the support base and the section other than the rib (the groove part) were detected by the optical sensor (the recording sheet detection sensor) and a threshold value corresponding to the result of a comparison between the respective detection voltages was set. However, the result of a comparison between the detection voltages for the rib of the support base and for the portion other than the rib (the groove part) has not been accurately indicative of the detection sensitivity. For this reason, a problem has emerged in that the threshold value set in accordance with the comparison result of the detection voltages also has not been suitable, and in that the detection accuracy of the edge position of a sheet of paper P has not been very high. When, for example, a print start position is set on the basis of an edge position for which such detection accuracy is not very high, then there has been the undesirable possibility that the position of the margin can deviate in the width direction during printing, or that ink droplets can be ejected onto sites other than the sheet of paper (a part of the support base).

In Patent Document 4, although the edge position of the sheet of paper can be detected a higher resolution than the detection resolution of a linear encoder, the threshold value compared with the approximation function in a case where there has been a decline in sensitivity due to such reasons as fouling of the optical sensor has not been reflective of the sensitivity of the optical sensor, and thus it has not been possible to detect the edge position of the sheet of paper at very favorable accuracy. Even were the threshold value corresponding to the comparison result for the detection voltages of the optical sensor having detected the rib of the support base and the portion other than the rib (the groove part) in Patent Documents 2 and 3 to be hypothetically applied to the printer in Patent Document 4, the threshold values in Patent Documents 2 and 3 have not been accurately reflective of the sensitivity, and therefore a high detection accuracy for the edge position of the sheet of paper cannot be expected. The foregoing problems apply not only to printers but also in a broad sense to any liquid ejecting apparatus having a functionality for detecting an edge position of a medium, such as a sheet of paper, in the width direction on the basis of an output value of an optical sensor provided to a carriage that moves in a movement direction intersecting with a conveyance direction for the medium.

The invention has been contrived in the light of the foregoing problems, and one advantage thereof is to provide a liquid ejecting apparatus and a method for detecting a medium edge position in a liquid ejecting apparatus whereby the edge position of a medium can be detected with comparatively favorable accuracy even when the sensitivity of an optical sensor has changed due to such reasons as fouling.

Means Used to Solve the Above-Mentioned Problems

In order to achieve the foregoing one advantage, the essence of one aspect of the invention resides in being provided with: a liquid ejecting head for ejecting a liquid toward a medium; a light reflection optical sensor which is provided to a carriage that moves reciprocatingly in a movement direction that intersects a conveyance direction of the medium, which has a light-emitting unit and a light-receiving unit, and which outputs an output value corresponding to an amount of light received by the light-receiving unit; a dark output value acquisition unit for acquiring a dark output value corresponding to the amount of light received by the light-receiving unit when at a position where the optical sensor targets for detection a dark region provided so that the amount of light received by the light-receiving unit receiving reflected light of light irradiated by the light-emitting unit is less than that of the medium; an approximation function acquisition unit for acquiring a plurality of coordinate points indicated by the position and the output value of a portion where the output value increases or decreases with respect to the change in position when the optical sensor, which moves in the movement direction, is within a range of positions where an edge of the medium is targeted for detection, in a state where the medium has been conveyed to a position where detection by the optical sensor is possible, and for computing an approximation function on the basis of the plurality of coordinate points; and an edge position detection unit for detecting the edge position of the medium on the basis of the approximation function and the dark output value.

According to the foregoing configuration, the dark output value acquisition unit acquires the dark output value corresponding to the amount of light received by the light-receiving unit when the optical sensor is at a position where the dark region is targeted for detection. The approximation function acquisition unit acquires a plurality of coordinate points indicated by the position and the output value of a portion where the output value increases or decreases with respect to the change in position when the optical sensor, which moves in the movement direction, is within a range of positions where an edge of the medium is targeted for detection, in a state where the medium has been conveyed to a position where detection by the optical sensor is possible, and computes an approximation function on the basis of the plurality of coordinate points. The edge position detection unit then detects the edge position of the medium on the basis of the approximation function and the dark output value. It is accordingly possible to detect the edge position of the medium with comparatively greater accuracy, even when fouling of the optical sensor or the like has caused a change in the sensitivity thereof.

In a liquid ejecting apparatus that is one aspect of the invention, preferably, the approximation function acquisition unit computes a linear approximation formula as the approximation function. According to the foregoing configuration, a linear approximation formula for the portion where the output value increases or decreases with respect to the change in the position of the optical sensor is computed. Because of the linear approximation formula, the edge position detection unit can detect an edge position that has little deviation from the actual edge position of the medium. Also, it is comparatively easier to compute when the approximation function acquisition unit is acquiring the approximation function, and to compute when the edge position detection unit is detecting the edge position of the medium.

In a liquid ejecting apparatus that is one aspect of the invention, preferably, the approximation function acquisition unit selects the plurality of coordinate points, the coordinate points being arranged side by side in a linear manner, from among the coordinate points at the portion where the output value increases or decreases with respect to the change in the position, and computes the linear approximation formula on the basis of the plurality of coordinate points.

According to the foregoing configuration, the approximation function acquisition unit selects the plurality of coordinate points, the coordinate points being arranged side by side in a linear manner, from among the coordinate points at the portion where the output value increases or decreases with respect to the change in the position, and computes the linear approximation formula on the basis of the plurality of coordinate points. For this reason, it is possible to avoid the coordinate points of a portion arranged side by side in a curved manner, caused by a detection error with the edge position, and to acquire the linear approximation formula by using the plurality of coordinate points of the portion arranged side by side in a linear manner. Accordingly, it is easier to acquire a linear approximation formula comparatively more accurately reflective of the sensitivity of the optical sensor. As such, a comparatively more precise edge position can be detected on the basis of the linear approximation formula and the dark output value.

In a liquid ejecting apparatus that is one aspect of the invention, preferably, in a case where the linear approximation formula is a first linear approximation formula, the dark output value acquisition unit acquires a plurality of coordinate points indicated by the position and the output value of when the optical sensor is at a position where the dark region is targeted for detection, and computes a second linear approximation formula on the basis of the plurality of coordinate points, and the edge position detection unit computes as the edge position the position of a point of intersection between the first linear approximation formula and the second linear approximation formula.

According to the foregoing configuration, the dark output value acquisition unit computes a second linear approximation formula on the basis of the plurality of coordinate points acquired when the optical sensor is at a position where the dark region is targeted for detection. The edge position detection unit then detects as the edge position the position of the point of intersection between the first linear approximation formula and the second linear approximation formula. Even in a case where, for example, the dark output value fluctuates somewhat with respect to the change in position (for example, is gradually increased, gradually lowered, or fluctuates up and down), it is possible to more accurately detect the edge position, because the position of the point of intersection between the first and second linear approximation formulae is acquired, by using the second linear approximation formula based on the plurality of coordinate points when at a position where the dark region is targeted for detection.

In a liquid ejecting apparatus that is one aspect of the invention, preferably, the dark output value acquisition unit acquires the dark output value on the basis of the output value of the light-receiving unit for when the optical sensor, at a position where the medium is not targeted for detection, detects the dark region and targets the dark region for detection, while the carriage is in the process of being moved in the movement direction for the purpose of detecting the edge position of the medium.

According to the foregoing configuration, the dark output value acquisition unit acquires the dark output value on the basis of the output value for when the optical sensor, at a position where the medium is not targeted for detection, detects the dark region and targets the dark region for detection, while the carriage is in the process of being moved in the movement direction for the purpose of detecting the edge position of the medium. The detection of the dark region is also carried out to acquire the dark output value while the carriage is in the process of being moved for the purpose of detecting the edge of the medium. For this reason, there is no need to move the carriage, separately from the edge position detection of the medium, with the purpose of acquiring the dark output value. As a result, this leads to a reduction in the number of times the carriage is moved with no relation to liquid ejecting processes, and, for example, leads to an enhancement in the throughput of the liquid ejecting apparatus.

In a liquid ejecting apparatus that is one aspect of the invention, preferably, the liquid ejecting apparatus is provided with a control unit for causing the carriage to be moved in the movement direction at a timing where the liquid ejecting apparatus is powered on and/or at a timing where the cumulative number of media that have undergone liquid ejecting processing by the liquid ejecting head reaches a setting value, and the dark output value acquisition unit acquires the dark output value on the basis of the output value for when the optical sensor is at a position where the dark region is targeted for detection while the carriage is in the process of being moved in the movement direction.

According to the foregoing configuration, the control unit causes the carriage to be moved in the movement direction at a timing where the liquid ejecting apparatus is being turned on and/or at a timing where the cumulative number of media that have undergone liquid ejecting processing by the liquid ejecting head reaches a setting value. The dark output value acquisition unit acquires the dark output value on the basis of the output value for when the optical sensor is at a position where the dark region is targeted for detection. Because movement of the carriage for the dark output value acquisition unit to acquire the dark output value is carried out at a timing where the liquid ejecting apparatus is powered on and/or at a timing where the cumulative number of media that have undergone the liquid ejecting processing reaches the setting value, it is possible to correspondingly reduce the frequency of movement of the carriage for acquiring the dark output value, and this leads, for example, to an enhancement in the throughput of the liquid ejecting apparatus.

In a liquid ejecting apparatus that is one aspect of the invention, preferably, the liquid ejecting apparatus is further provided with a support unit having a plurality of protrusions for supporting the medium and a first detection unit for detecting the edge of the medium by comparing a threshold value at which the medium can be detected and the protrusions cannot be detected and an output value of the optical sensor, which moves in the movement direction, in a state where the medium has been conveyed to a position at which detection by the optical sensor is possible; and when the edge of the medium is detected by the first detection unit, the edge position is next detected by a second detection unit, which includes the approximation function acquisition unit, the dark output value acquisition unit, and the edge position detection unit.

According to the foregoing configuration, the first detection unit detects the edge of the medium by comparing a threshold value at which the medium can be detected and the protrusions cannot be detected and the output value of the optical sensor, which moves in the movement direction, in a state where the medium has been conveyed to a position where detection by the optical sensor is possible. When the edge of the medium is detected by the first detection unit, the second detection unit next detects the edge position of the edge detected by the first detection unit, by using the approximation function acquisition unit, the dark output value acquisition unit, and the edge position detection unit. In a case where, for example, the edge were to be detected with only the second detection unit, there is a concern that the edge of the protrusions might be erroneously detected as being the edge of the medium, but because a procedure is followed in which the first detection unit detects the edge of the medium without using the threshold value at which the protrusions cannot be detected and, after the detection of the edge of the medium, the edge position of the edge thus detected is detected by the second detection unit, it is possible to detect the edge position of the medium while also avoiding erroneous detection of the edge of the protrusions as being the edge of the medium.

One aspect of the invention is a method for detecting a medium edge position in a liquid ejecting apparatus, in which an edge position of a medium in a movement direction is detected on the basis of a position and an output value of a light reflection optical sensor which is provided to a carriage that moves in the movement direction, intersecting with a conveyance direction of the medium, and which has a light-emitting unit and a light-receiving unit, the essence of this aspect residing in including: a dark output value acquisition step for acquiring a dark output value corresponding to the amount of light received by the light-receiving unit when at a position where the optical sensor targets for detection a dark region provided so that the amount of light received by the light-receiving unit receiving reflected light from the light irradiated by the light-emitting unit is less than that of the medium; an approximation function acquisition step for acquiring a plurality of coordinate points in a portion where the output value increases or decreases with respect to the position in a range of positions where the optical sensor, which moves in the movement direction, targets the edge of the medium for detection, in a state where the medium has been conveyed to a position at which detection by the optical sensor is possible, and for computing an approximation function on the basis of the plurality of coordinate points; and an edge position detection step for detecting the edge position of the medium on the basis of the approximation function and the dark output value. According to the foregoing method, an effect similar to that of the invention relating to the liquid ejecting apparatus can be obtained.

BRIEF DESCRIPTION OF THE DRAWINGS

Referring now to the attached drawings which form a part of this original disclosure.

DETAILED DESCRIPTION OF EXEMPLARY EMBODIMENTS

First Embodiment

What follows is a description of a first embodiment, in which the liquid ejecting apparatus of the invention is embodied as an ink jet printer, with reference to FIGS. 1 to 12.

Figure 1:
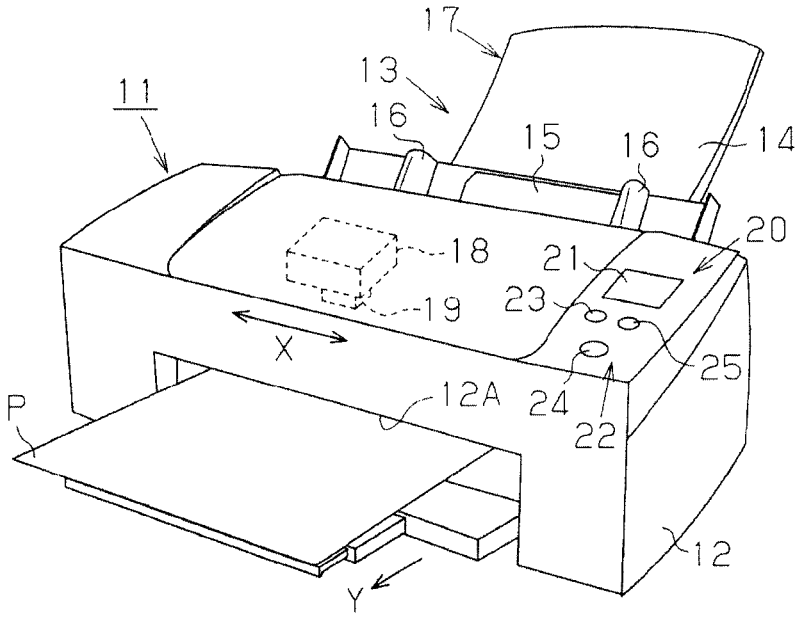
FIG. 1 is a perspective view of a printer in a first embodiment.

As is illustrated in FIG. 1, the ink jet printer which is one example of the liquid ejecting apparatus (hereinafter, simply called a "printer 11") is equipped with an auto sheet feeder device 13 for conveying a sheet of paper P (sheet), serving as one example of medium, at the rear side of a main body 12. The auto sheet feeder device 13 is provided with a sheet feeder tray 14, a hopper 15, and a paper sheet guide 17 having edge guides 16, and feeds sheets of paper having been set into the paper sheet guide 17 one sheet at a time to the inside of the main body 12. The left/right pair of edge guides 16 guide a sheet of paper P in the width direction, centered on a width-direction middle position of the sheet feeder tray 14.

Inside of the main body 12, a carriage 18 is provided in a state allowing reciprocating movement in a movement direction X (a main scanning direction) along a movement path thereof, and a liquid ejecting head 19 is attached at a lower part of the carriage 18. Substantially in alternation, the printer 11 repeats a recording operation, in which ink droplets are ejected onto the surface of the sheet of paper P from the liquid ejecting head 19 while the carriage 18 is in the process of moving in the movement direction X, and a sheet feed operation, in which the sheet of paper P is conveyed by a requested conveyance amount in a conveyance direction Y (a secondary scanning direction) intersecting with the movement direction X; an image, text, or the like based on given print data is printed onto the sheet of paper P. The sheet of paper P after printing is discharged from a sheet discharge port 12A opening on a front side lower part of the main body 12.

An operation panel 20 is also provided to an upper surface end part of the main body 12. Provided to the operation panel 20 are a display unit 21, including a liquid crystal display panel or the like, and an operation switch 22. Provided to the operation switch 22 are a power source switch 23, a print start switch 24, a cancel switch 25, and the like. The display unit 21 can be a touch panel.

Figure 2:
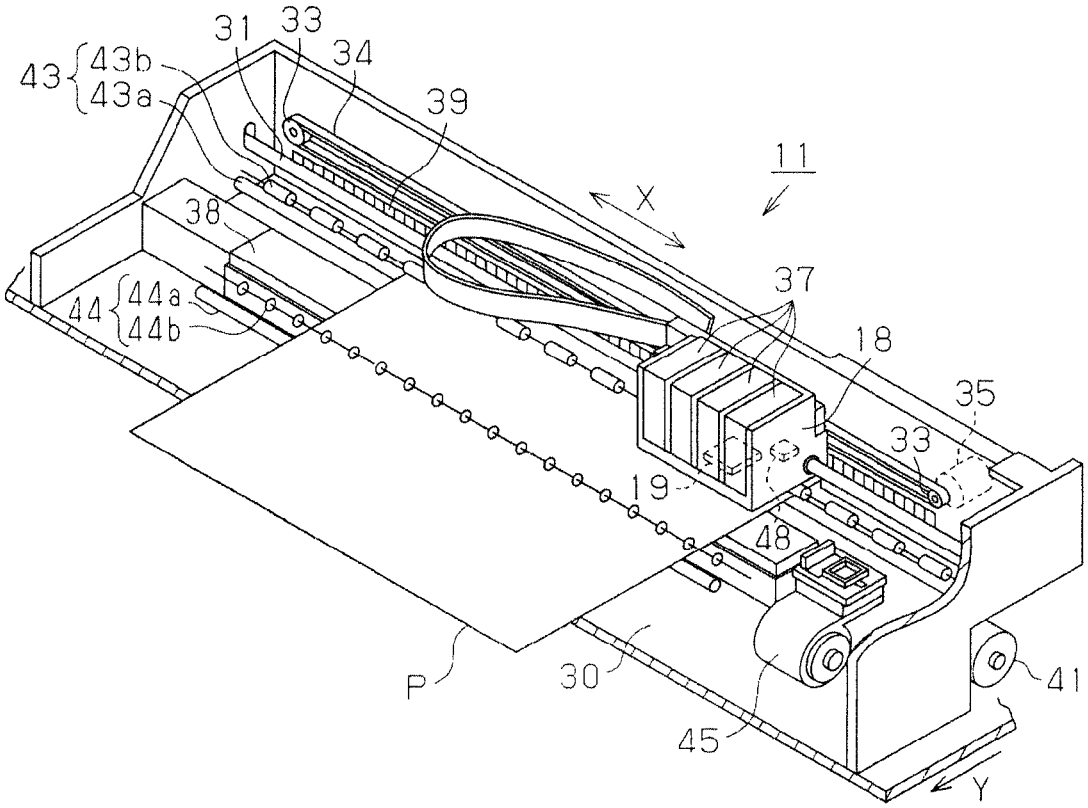
FIG. 2 is a perspective view illustrating a configuration of a printer.

Next, the internal configuration of the printer 11 shall be described. As is illustrated in FIG. 2, the printer 11 has a substantially quadrangular box-shaped main body frame 30, the upper side and front side of which are open; the carriage 18 is attached in a state allowing reciprocating movement in the movement direction X at a guide shaft 31, which is bridged between left and right side walls of the main body frame 30 in FIG. 2. An endless timing belt 34 is wound about a pair of pulleys 33 mounted onto an inner surface of a back plate of the main body frame 30, and the carriage 18 is fixed to a part of the timing belt 34. Coupled to the right-side pulley 33 in FIG. 2 is a drive shaft (output shaft) of a carriage motor 35; when the carriage motor 35 is driven forward and in reverse and the timing belt 34 turns forward and in reverse, the carriage 18 is thereby moved reciprocatingly in the movement direction X.

A plurality (for example, four) of ink cartridges 37 in which different colors of ink (for example, the four colors of black (K), cyan (C), magenta (M), and yellow (Y)) are respectively contained are loaded into an upper part of the carriage 18. Ink that is supplied from each of the ink cartridges 37 is respectively ejected from nozzles in a corresponding nozzle row NA (see FIG. 5), there being the same number of nozzle rows formed on the liquid ejecting head 19 (in the present example, four) as there are colors of ink. A support base 38, serving as one example of a support unit, for regulating the interval (gap) between the liquid ejecting head 19 and the sheet of paper P is provided to a position below the movement path of the carriage 18 so as to extend in the movement direction X. The ink colors that can be ejected by the liquid ejecting head 19 need not be four in number; there can also be one color, three colors, or five to eight colors.

A linear encoder 39 for outputting a number of pulses that is proportional to an amount of travel by the carriage 18 is provided to a back surface side of the carriage 18 so as to extend along the guide shaft 31. In the printer 11, positional control and speed control of the carriage 18 are carried out on the basis of a pulse signal that is outputted from the linear encoder 39.

A conveyance motor 41 is disposed at a right-side lower part in FIG. 2 of the main body frame 30. A sheet feeder roller (not shown) is driven by the power of the conveyance motor 41, whereby the sheets of paper P that have been set into the sheet feeder tray 14 (see FIG. 1) are fed out one sheet at a time. A conveyor roller pair 43 and a discharge roller pair 44 are each arranged on a downstream side and upstream side thereof sandwiching the support base 38 in the conveyance direction Y. Each of the roller pairs 43, 44 includes a drive roller 43*a*, 44*a* that is rotated by the power of the conveyance motor 41 and a driven roller 43*b*, 44*b* that turns together with the rotation of the drive roller 43*a*. When the conveyance motor 41 is driven, the sheet of paper P is thereby conveyed in the conveyance direction Y (the secondary scanning direction) in a state of being sandwiched (nipped) between the two roller pairs 43, 44.

In FIG. 2, a position at one end on the movement path of the carriage 18 (in FIG. 2, this is the rightmost position) serves as a home position at which the carriage 18 remains on standby when printing is not taking place. A maintenance device 45 for cleaning and otherwise maintaining the liquid ejecting head 19 is disposed directly below the carriage 18 arranged at the home position. In the present embodiment, the conveyance motor 41 also serves as a source of power for the maintenance device 45. In addition, a sheet width sensor 48, serving as one example of an optical sensor, for detecting the ends (edges) on both sides of the sheet of paper P in the width direction (the movement direction X) is provided to the carriage.

Figure 5:
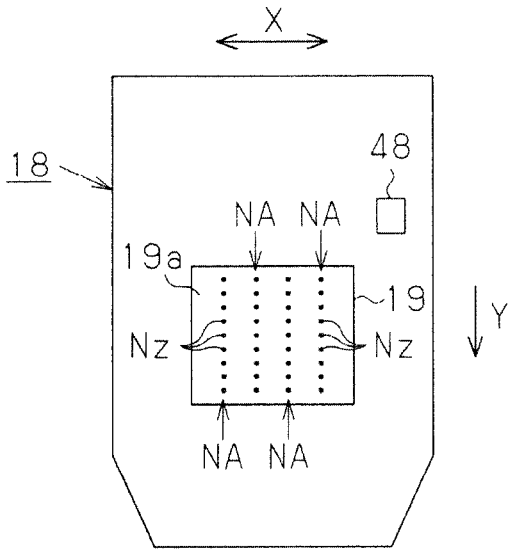
FIG. 5 is a bottom view of a liquid ejecting head.

FIG. 5 illustrates the bottom of the carriage. A plurality of nozzle rows NA, formed by a plurality of nozzles Nz being arrayed at a constant pitch in the conveyance direction Y in a state where the carriage 18 has been assembled in the printer 11, are arrayed at a predetermined spacing in the movement direction X on a nozzle formation surface 19*a* of the liquid ejecting head 19, which is attached to a substantially middle position of the bottom of the carriage 18. The ink that is supplied from the corresponding ink cartridge 37 is ejected from the nozzles Nz constituting the nozzle rows NA. The sheet width sensor 48 is attached on the bottom of the carriage 18 to a position farther on the upstream side in the conveyance direction Y than the liquid ejecting head 19.

Figures 3A, 3B:
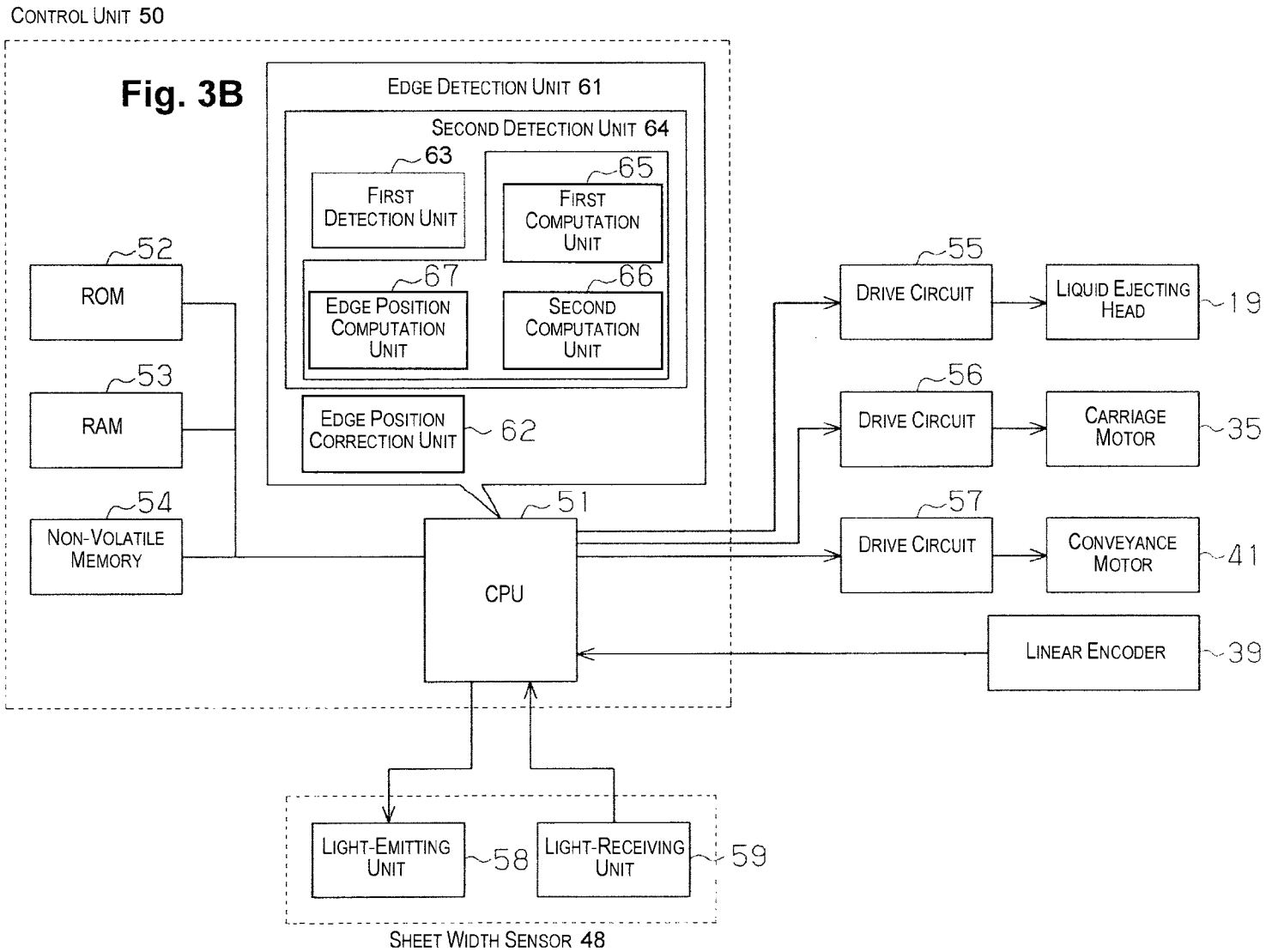
FIG. 3A is a block diagram illustrating an electrical configuration of a printer.
FIG. 3B is a block diagram illustrating a functional configuration of a control unit.

The electrical configuration of the printer 11 shall now be described on the basis of FIGS. 3A and 3B. The printer 11 illustrated in FIGS. 3A and 3B is provided with a control unit 50 for governing the overall control thereof. The control unit 50 is constituted of, for example, a computer (a microcomputer), and is provided with a CPU 51 (a central processing unit), a ROM 52, a RAM 53, and a non-volatile memory 54. The ROM 52 stores a variety of types of programs. Some programs, setting data for when a variety of types of programs are to be executed, and the like are stored in the non-volatile memory 54, which also retains the stored contents even when the power is turned off. The CPU 51 controls the print operation of the printer 11 and the like by executing programs stored in the ROM 52 and in the non-volatile memory 54. An application specific integrated circuit (ASIC) can also be added, with the data processing needed for drive control of the liquid ejecting head 19 and the like then being performed by the ASIC.

The control unit 50 drives and controls the liquid ejecting head 19 via a drive circuit 55 on the basis of print data, and causes ink to be ejected from the liquid ejecting head 19. The control unit 50 also drives and controls the carriage motor 35 via a drive circuit 56, and causes the carriage 18 to move reciprocatingly in the movement direction X. The control unit 50 further drives and controls the conveyance motor 41 via a drive circuit 57, and causes the sheet of paper P to be conveyed in the conveyance direction Y. The control unit 50 detects a position of the carriage 18 (carriage position) in the movement direction X, with the home position as the point of origin, on the basis of a pulse signal inputted from the linear encoder 39. More specifically, the control unit 50 is provided with a counter for using the point in time where the carriage 18 is at the home position as the point of origin to count the number of pulse edges of the pulse signal inputted from the linear encoder 39, and increments the count of the counter upon forward movement of the carriage 18 and decrements the count upon return movement of the carriage 18. For this reason, the count of the counter is meant to be indicative of the position of the carriage 18 in the movement direction X (the carriage position).

The sheet width sensor 48, which is connected to the control unit 50, is provided with a light-emitting unit 58 for irradiating light towards the support base 38 (in the present example, this is downward in the vertical direction) and a light-receiving unit 59 for receiving reflected light of the light irradiated from the light-emitting unit 58. The control unit 50 controls the light emission from the light-emitting unit 58, and receives the input of an output voltage corresponding to the amount of light received thereby from the light-receiving unit 59.

FIG. 3B illustrates a functional configuration which functions by the CPU 51 executing a program that is read from the ROM 52 or the non-volatile memory 54. As a function unit for functioning by the CPU 51 executing a program, the control unit 50 is provided with an edge detection unit 61 for detecting the edge position of the sheet of paper P, and an edge position correction unit 62 for correcting the edge detection position detected and acquired by the edge detection unit 61. To acquire the edge detection position, the edge detection unit 61 is provided with a first detection unit 63 for detecting a widthwise edge of the sheet of paper P, and a second detection unit 64 for subsequently detecting the position of the edge (edge position) of the edge thus detected. The second detection unit 64 is provided with a first computation unit 65 for computing a dark voltage Vd by using the output voltage Vo of when the sheet width sensor 48 detected the groove parts 71 (see FIGS. 4 and 6), and a second computation unit 66 for computing a linear approximation formula for a portion where, of the positions x and output voltages Vo when the sheet width sensor 48 detects the edge of the sheet of paper P, the relationship between the two reaches a proportional relationship (a linear shape of constant slope). The second detection unit 64 is also provided with an edge position computation unit 67 for computing the edge detection position on the basis of the dark voltage Vd and the linear approximation formula computed by the first and second computation units 65, 66. Each of these units 61 to 67 shall be described in greater detail below. In the present embodiment, the first computation unit 65 for computing the dark voltage Vd (equivalent to one example of a dark output value), which is an output value of the sheet width sensor 38 upon detecting the groove parts 71*a*, which are one example of a dark region, is equivalent to one example of a dark output value acquisition unit. The second computation unit 66 for computing the linear approximation formula (equivalent to one example of an approximation function) is equivalent to one example of an approximation function acquisition unit. The edge position computation unit 67 is equivalent to one example of an edge position detection unit.

Figure 4:
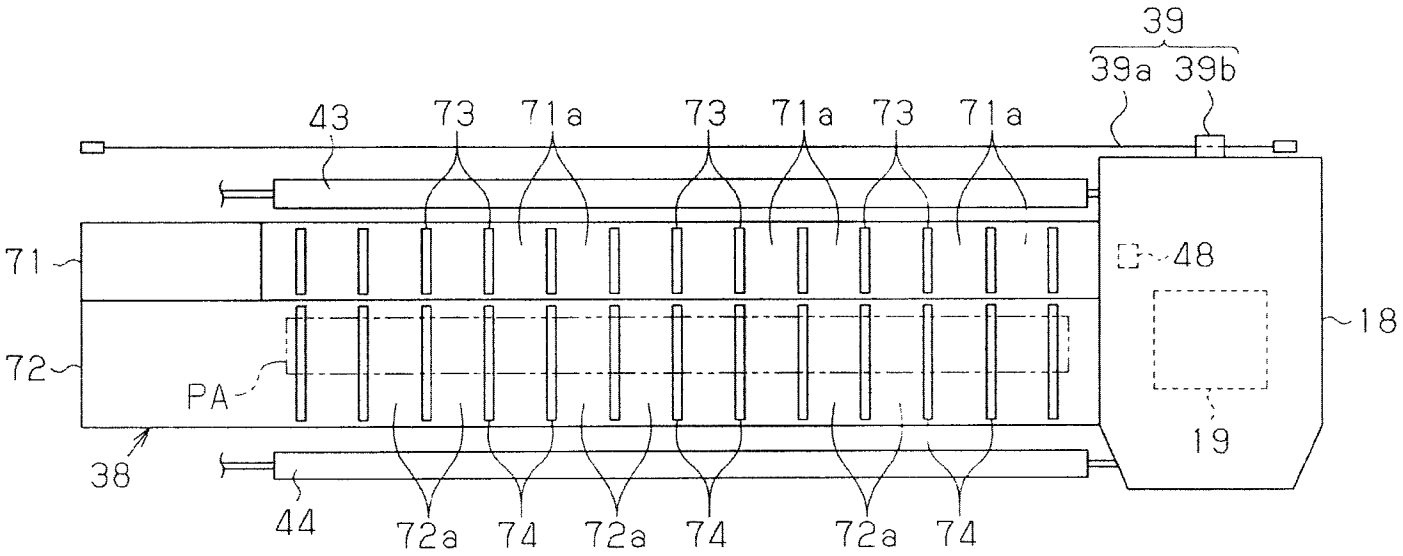
FIG. 4 is a schematic plan view illustrating a carriage, a support base, and so forth.
Figure 6:
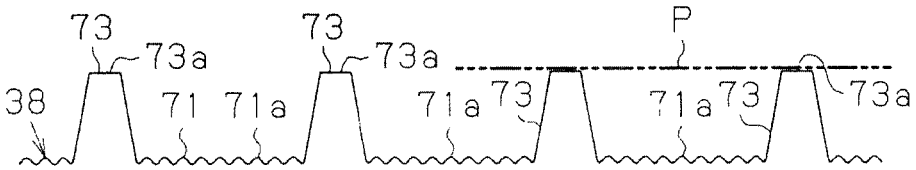
FIG. 6 is a schematic front view illustrating one part of a support base.
Figure 7:
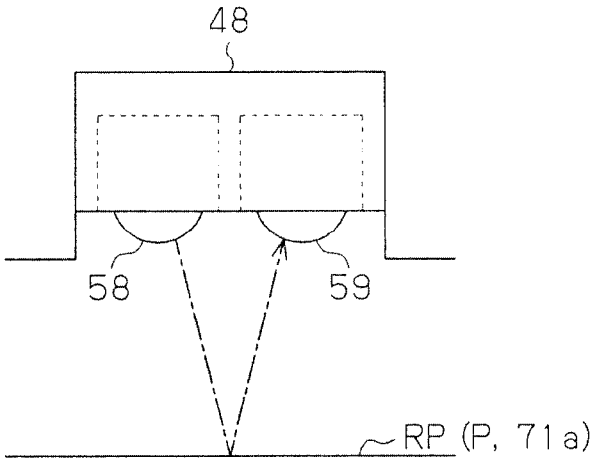
FIG. 7 is a schematic front view illustrating a sheet width sensor.

The following is describes the support base 38 and the sheet width sensor 48 in greater detail, with reference to FIGS. 4, 6, and 7. As illustrated in FIG. 4, formed on the support base 38 are: an upstream support surface 71 located on the upstream side in the conveyance direction Y, and a downstream support surface 72 located on the downstream side in the conveyance direction Y with respect to the upstream support surface 71. Upstream ribs 73, serving as one example of a protrusion, which project upward in the vertical direction (this is the front side of the plane of paper in FIG. 4) and extend in the conveyance direction Y are formed on the upstream support surface 71. Downstream ribs 74 that project out upward in the vertical direction and extend in the conveyance direction Y are formed on the downstream support surface 72. From the lower side in the vertical direction, both the upstream ribs 73 and the downstream ribs 74 support the sheet of paper P being conveyed, and the sheet of paper P illustrated in FIG. 2 is conveyed along the upstream ribs 73 and the downstream ribs 74.

As illustrated in FIG. 4, the groove parts 71*a* (see FIG. 6), which have a lower bottom surface than the upper end surface of the upstream ribs 73, are formed at portions other than the upstream ribs 73 on the upstream support surface 71. Also, groove parts 72*a*, which have a lower bottom that an upper end surface of the downstream ribs 74, are formed on portions other than the downstream ribs 74 on the downstream support surface 72.

In FIG. 4, the right edge position at which the carriage 18 is located serves as the home position. A liquid ejecting region PA (print region), which is the maximum area where the liquid ejecting head 19 is able to eject ink drops for printing in the movement direction X of the carriage 18, is located atop the downstream support surface 72, as illustrated by the two-dot chain line in FIG. 4. A region targeted for detection by the sheet width sensor 48 is the upstream support surface 71, located further on the upstream side in the conveyance direction Y than the upstream support surface 71, at which the liquid ejecting region PA is located, and thus the region targeted for detection is located outside of the liquid ejecting region PA. Ink drops ejected in the vicinity of the outside of the sheet of paper P from the liquid ejecting head 19 during borderless printing attach to the downstream support surface 72, as do ink drops ejected from the liquid ejecting head 19 during a paper jam. By contrast, the ink mist and the like are comparatively less likely to attach to the upstream support surface 71 than to the upstream support surface 71, at which the liquid ejecting region PA is located.

The sheet of paper P, which is positioned in the width direction by the pair of edge guides 16 illustrated in FIG. 1, is fed out so that the width center thereof passes through a widthwise middle position of the conveyance path. For this reason, the positions of the edges of both sides (the edge positions) in the width direction of the sheet of paper P when the sheet of paper is conveyed over the support base 38 in FIG. 4 are determined by the width of the sheet of paper P. In the present embodiment, the position of each of the upstream ribs 73 in the movement direction X is set for a sheet of paper P of a prescribed size so that the two edge positions thereof in the width direction are positioned to face the groove parts 71*a*. Because of this, the two edges in the width direction of the sheet of paper P conveyed over the support base 38 are located so as to face the groove parts 71*a* at all times (see FIG. 6).

As illustrated in FIG. 7, the sheet width sensor 48, which is fixed to the surface side opposing the support base 38 (the lower surface side) on the carriage 18, is attached to a comparatively closer position in a state where the light-emitting unit 58 and the light-receiving unit 59 are adjacent to each other. The distance between the optical axes of the light-emitting unit 58 and the light-receiving unit 59 is very short, and light that is irradiated vertically downward from the light-emitting unit 58 is reflected by a reflecting surface RP of an object targeted for irradiation with light, where reflected light reflected substantially vertically upward is received by the light-receiving unit 59. The optical paths of the irradiated light and the reflected light are schematically illustrated in FIG. 7 with single-dot chain lines extending at a slope. The reflecting surface RP of the object targeted for irradiation with light includes the surface of the sheet of paper P, the groove parts 71*a*, and the like.

As illustrated in FIG. 6, the bottom surface of the groove parts 71*a* on the support base 38 are formed in a relatively fine wavy shape, and light that is irradiated substantially vertically to the groove parts 71*a* from the light-emitting unit 58 is prone to diffuse reflection. Because of this, the groove parts 71*a* serve as a dark region; the light-receiving unit 59 receives a very small amount of light from the light reflected by the groove parts 71*a*, and the output voltage value of the light-receiving unit 59 (the dark voltage Vd) is extremely small. The sheet of paper P, which has a higher light reflectance, serves as a bright region; the light-receiving unit 59 receives a correspondingly higher amount of light from the reflected light from the sheet of paper P, and the output voltage of the light-receiving unit 59 is correspondingly greater.

The support surface 73*a* of the upstream ribs 73, due to the sliding of the sheet of paper P, is abraded and gradually becomes more mirror-like. Because of this, the reflectivity of the support surface 73*a* changes together with the passage of time, and gradually increases until finally becoming mirror-like. Accordingly, upon detection of the sheet of paper P, when the sheet width sensor 48 moves, for example, in the rightward direction from the left end side in FIG. 6, the groove parts 71*a* and the upstream ribs 73 are alternatingly targeted for detection until the sheet width sensor moves to the position where it is the sheet of paper P that is targeted for detection, and, during this time, the output voltage for when the upstream ribs 73 are targeted for detection is relatively higher.

Figures 8A, 8B:
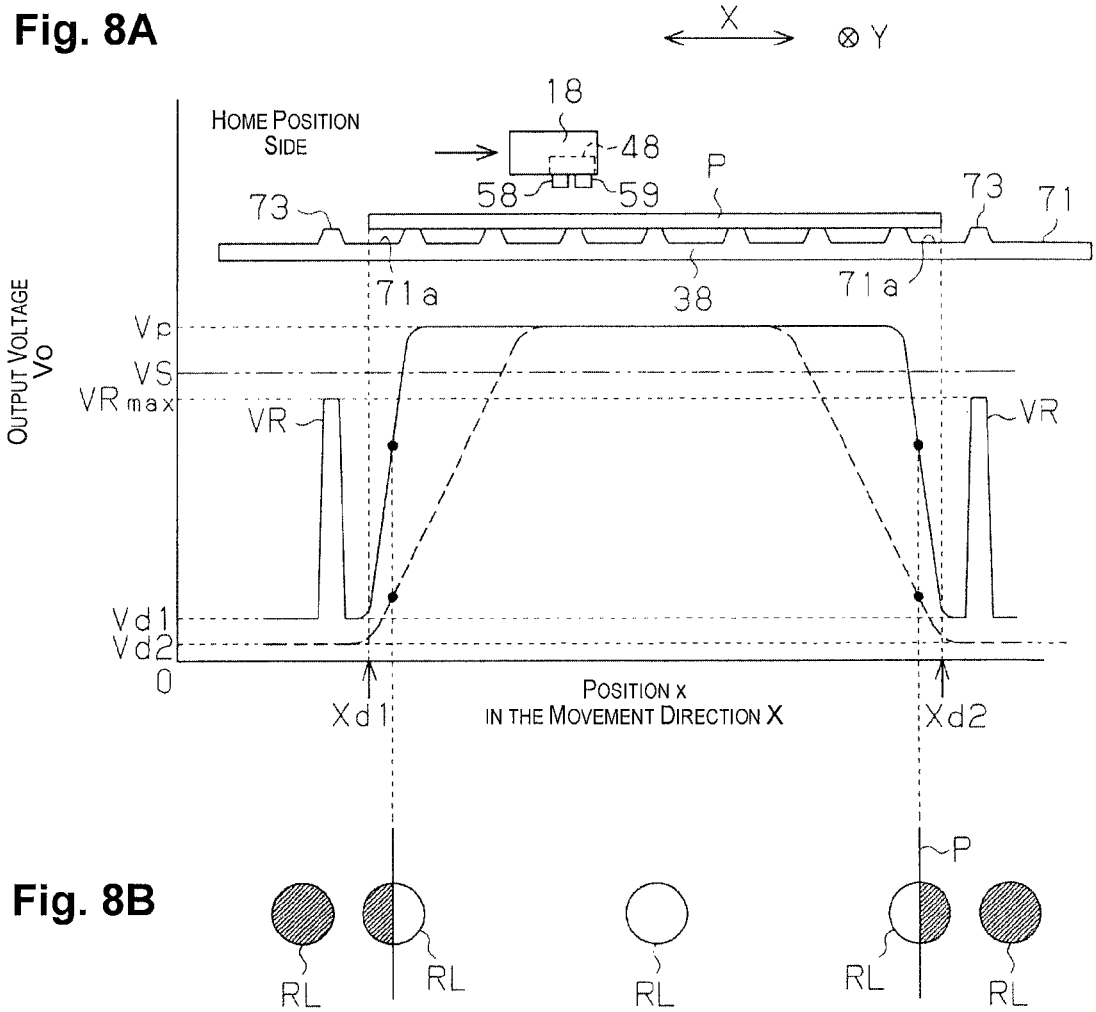
FIG. 8A is a graph illustrating the relationship between the position of a sheet width sensor in a movement direction and an output voltage.
FIG. 8B is a schematic plan view illustrating the relationship between a sheet of paper and reflected light.

A method for detecting the edge position of the sheet of paper P by the sheet width sensor 48 shall now be described, with reference to FIGS. 8A and 8B. FIGS. 8A and 8B illustrate the example of a case where the carriage 18 moves in the movement direction X and the edge of the sheet of paper P are detected by the sheet width sensor 48, in a state where the sheet of paper P has been conveyed as far as a position where the support base 38 (more specifically, the upstream support surface 71) is covered. The graph illustrated in FIG. 8A illustrates the relationship between a position x (hereinafter, also called a "sensor position x") of the sheet width sensor 48 in the movement direction X and the output voltage Vo of the light-receiving unit 59. In this graph, the graph line illustrated by the solid line illustrates the relationship between the sensor position x and the output voltage Vo at an initial stage before the sheet width sensor 48 has been fouled, and the graph line illustrated by the dashed line illustrates the relationship between the sensor position x and the output voltage Vo at a point in time where the sheet width sensor 48 has been fouled to such an extent that, for example, the sensitivity thereof reaches an allowable limit.

FIG. 8B illustrates the form of the column of reflected light RL reflected by the groove parts 71*a* or the sheet of paper P when the edge position of the sheet of paper P is being detected. A region where a lesser amount of light is reflected by the groove parts 71*a*, which is the dark region, is illustrated with a dark grey color, and a region where a greater amount of light is reflected by the surface of the sheet of paper P, which is the bright region, is illustrated with a white color. In FIG. 8B, the edge of the sheet of paper P illustrates the edge detection position, and is drawn at a position slightly shifted inward from the actual edge position of the sheet of paper P illustrated in FIG. 8A.

In FIG. 8B, when the groove parts 71*a* on the outside of the sheet of paper P in the width direction are what is targeted for detection (when the reflected light RL is the dark grey color), an extremely low dark voltage Vd1 (or Vd2) is outputted from the light-receiving unit 59, which has received the reflected light RL of a lesser amount of light reflected by the groove parts 71*a*. When the amount of the reflected light RL that is accounted for by the sheet reflection light reflected by the surface of the sheet of paper P (hereinafter, also called the "paper contribution") reaches half, then the light-receiving unit 59 outputs an output voltage Vo (the black point in FIG. 8A) that corresponds to the amount of received light for a paper contribution "0.5". In a segment where the sheet of paper P is targeted for detection, an output voltage (hereinafter, also called the "paper voltage Vp") greater than the threshold value VS is outputted from the light-receiving unit 59 receiving the reflected light RL, which has a greater amount of light that is reflected by the surface of the sheet of paper P.

As the sheet width sensor 48 is increasingly fouled from the initial state and as the sensitivity thereof is increasingly lowered, the amount of light of the reflected light RL, too, gradually decreases, and the relationship between the position x and the output voltage Vo is such that the dark voltage Vd gradually declines from the graph line of the initial state illustrated by the solid line in FIG. 8A; the graph line shifts inward in the width direction of the sheet of paper P from the solid line so as to become the dashed line, where the dark voltage Vd declines and the rising and falling slopes of the line in the process of detecting the edge of the sheet of paper P (the process where the paper contribution changes) become smaller. Herein, the graph line illustrated by the dashed line in FIG. 8A is for illustrating the relationship between the position x and the output voltage Vo for when, for example, the sheet width sensor 48 reaches a sensitivity limit due to fouling. In the present embodiment, a linear approximation formula approximating the sloped portion where the slope or the like changes in accordance with the sensitivity of the sheet width sensor 38 is found, and edge detection positions Xd1, Xd2 are found by using the linear approximation formula and the dark voltage at the sensitivity thereof. The widthwise edge position of the sheet of paper P is detected by carrying out a correction for the edge detection positions Xd1, Xd2, where the known amount of positional deviation to the actual edge position of the sheet of paper P is used as a correction amount.

It has been noted that each of the upstream ribs 73 is present at a position further outward in the width direction than the two widthwise edges of the sheet of paper P. In a case where the carriage 18 moves in the direction illustrated with the arrow in FIG. 8A, then before detecting the first edge of the sheet of paper P, the sheet width sensor 48 passes through a position above the upstream ribs 73 located further toward the home position than same, and after detecting the second edge of the sheet of paper P, the sheet width sensor 48 passes through a position above the upstream ribs 73 located further toward the anti-home position than same. As will be understood from the graph illustrated in FIG. 8A, when the sheet width sensor 48 is at the position x where the upstream ribs 73 are what is targeted for detection, there appears a waveform of the output voltage for when the upstream ribs 73 are detected (hereinafter, also called a "rib waveform VR"). When, for example, the support surface of the upstream ribs 73 is abraded so as to be mirror-like by the sliding of the sheet of paper P and reaches a high reflectivity, a maximum voltage VRmax of the rib waveform VR will have become appreciably closer to the paper voltage Vp. Such a case results in finding a linear approximation formula for the rising or falling slope portion of the rib waveform VR for when the upstream ribs 73 are detected, and there is a concern that this can be the cause of an erroneous detection of the edge of the upstream ribs 73 as being the edge of the sheet of paper P.

In the present embodiment, in order to avoid erroneous detection of the upstream ribs 73, a threshold VS whereby the upstream ribs 73 cannot be detected and the sheet of paper P can be detected is set. The threshold value VS is set to a value greater than an anticipated maximum voltage VRmax of the rib waveform VR, and smaller than the paper voltage Vp (which, in this example, is a saturation voltage) (VRmax<VS<Vp). Further, the present embodiment assumes a procedure in which first the first detection unit 63 detects the edge of the sheet of paper P while avoiding erroneous detection of the edge of the upstream ribs 73 by using the threshold value VS, and checks by detection to ensure that this is the edge of the sheet of paper P, next the second detection unit 64 detects the edge position of the edge detected thereby.

Each of the units 61 to 67 in FIG. 3B shall now be described in greater detail. The edge detection unit 61 detects the position of the widthwise edge of the sheet of paper P on the basis of the output voltage Vo that is inputted from the light-receiving unit 59. The edge detection unit 61 is provided with the first detection unit 63 and the second detection unit 64, in order to detect the edge position of the sheet of paper P.

While the carriage 18 is in the process of moving in the movement direction X from one outside position in the width direction of the sheet of paper P to the other outside position in the width direction, in a state where the sheet of paper P has been conveyed in the conveyance direction Y to a position where the upstream support surface 71 is covered, the first detection unit 63 compares the output voltage Vo of the sheet width sensor 48 and the threshold value VS, and detects the edge of the sheet of paper P in response to when the output voltage Vo has crossed over the threshold value VS. The threshold value VS, as described above, is set to a value where the relationship VRmax<VS, Vp is satisfied. In this example, the threshold value VS is in particular VRmax+m1<VS<Vp−m2. Herein, m1 and m2 are margins.

When the first detection unit 63 detects the edge of the sheet of paper P, the second detection unit 64 next detects the edge position of the edge detected by the first detection unit 63 (the edge detection position Xd) by using the output voltage Vo of the sheet width sensor 48. The second detection unit 64 is provided with the first computation unit 65, the second computation unit 66, and the edge position computation unit 67 described above. While the carriage 18 is in the process of moving in the movement direction X for the purpose of edge detection processing, in order to ensure data for use in the second detection processing, the second detection unit 64 acquires in succession the position x and the output voltage Vo of the sheet width sensor 48 for every iteration of a predetermined cycle time (for example, a predetermined value in the range of 10 microseconds to 100 milliseconds), and stores same in a predetermined storage region of the RAM 53. At this time, the second detection unit 64 calculates a voltage differential value dVo on the basis of the position x and the output voltage Vo, and stores the voltage differential value dVo thus calculated in succession in the predetermined storage region of the RAM 53 in association with the position x and the output voltage Vo. A data group, formed when a plurality of coordinate points indicated by the position x, the output voltage Vo, and the voltage differential value dVo are saved in the predetermined storage region of the RAM 53 in this manner, is used when the first computation unit 65 and the second computation unit 66 run computations.

The first computation unit 65 acquires a plurality of output voltages Vo for when the target of detection by the sheet width sensor 48 is the groove parts 71*a* (the dark region), and calculates the average value for the plurality of output voltages Vo to acquire the dark voltage Vd. While the edge of the sheet of paper P is being detected and the paper contribution of the reflected light RL is in the process of changing, the second computation unit 66 runs a computation that is based on a linear approximation method known in the art to find a linear approximation formula by using the plurality of coordinate points (x, Vo) in the segment where the output voltage Vo changes at a substantially constant slope. The edge position computation unit 67 computes the sensor position x for when the output voltage Vo is the dark voltage Vd, on the basis of the linear approximation formula and the dark voltage Vd, and acquires the position x as the edge detection position Xd. Each of these computation units 65 to 67 shall be described in greater detail below.

In the present example, in addition to the counter (not shown) for counting the position of the carriage 18 in the movement direction X (the carriage position) as ascertained on the basis of the pulse signal of the linear encoder 39, further provided is a counter (not shown) for counting the position x of the sheet width sensor 48 at that time, on the basis of the known distance in the movement direction X between the carriage position and the position of the sheet width sensor 48. The first detection unit 63 and the second detection unit 64 acquire the sensor position x on the basis of the count of the counter, and acquire the coordinate points (x, Vo) from the sensor position x and the output voltage Vo of the sheet width sensor 48 at the sensor position x. It shall be readily understood that the sensor position x can also be acquired by carrying out a computation for adding or subtracting a value commensurate with this distance to/from the count of the carriage counter (the carriage position).

Figures 9, 10:
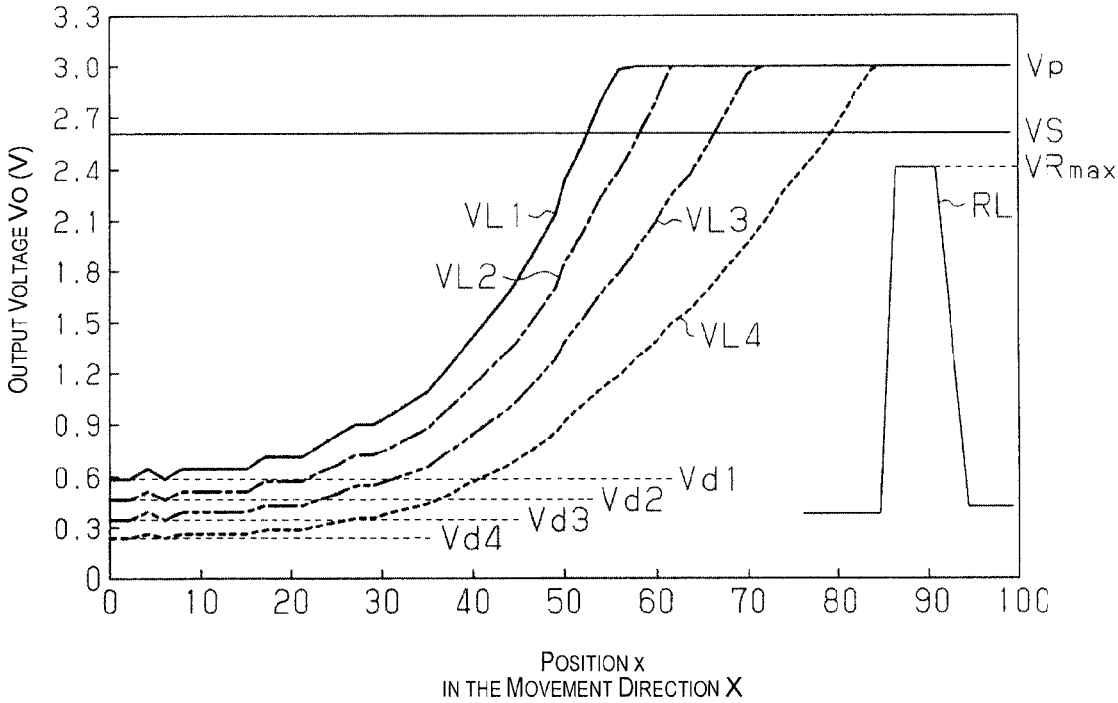
FIG. 9 is a schematic diagram illustrating correction data.
FIG. 10 is a graph illustrating the relationship between an output voltage and a position, for describing a first detection process.

The edge position correction unit 62 corrects the edge detection position Xd with the correction amount dx, to acquire the edge position Xe (edge position) (Xe=Xd+dx). The non-volatile memory 54 stores correction data CD, illustrated in FIG. 9. As illustrated in FIG. 9, the correction data Cd includes a correction amount dx1 that is used in correcting the first edge of the sheet of paper P, and a correction amount dx2 that is used in correcting the second edge of the sheet of paper P. In the present example, the positional coordinates of the position x of the sheet width sensor 48 in the movement direction X are set so that the direction from the home position toward the anti-home position becomes a positive direction. For this reason, the correction amount dx1, which is used in a case where the edge detection position Xd1 of the first edge, which is the edge closer to the home position, of the sheet of paper P is being corrected, takes a negative value (in the example in FIG. 9, this is −0.3 mm), and the correction amount dx2, which is used in a case where the edge detection position Xd1 of the second edge, which is the edge closer to the anti-home position, is being corrected, takes a positive value (in the example in FIG. 9, this is 0.5 mm). As another correction amount, a test print of the printer 11 during, for example, shipment inspection, is carried out to measure the amount of widthwise positional deviation of the print region with respect to the sheet of paper, for each of the different print directions (carriage movement directions), and a correction amount capable of correcting for the amount of positional deviation is set for each individual printer.

The graph illustrated in FIG. 1 is for describing the first detection processing by the first detection unit 63, and illustrates the relationship between the position x and the output voltage Vo in the movement direction X of the sheet width sensor 48. The position x is indicated by the count of the counter for counting the number of pulse edges of the pulse signal of the linear encoder 39, and the units thereof are 1/600 inch (where 1 inch=25.4 mm). In the graph in FIG. 10, the graph line VL1 illustrated with the solid line is of the initial state where there is no fouling of the sheet width sensor 48; fouling progresses in the stated order of the graph lines VL2, VL3, and VL4, which are illustrated by the single-dot chain line, the two-dot chain line, and the dashed line, respectively. The graph line VL4 illustrates when fouling has reached an extent where the sensitivity of the sheet width sensor 48 arrives at the allowable limit.

As will be understood from the graph lines VL1 to VL4, when the sheet width sensor 48 is at the position x where the groove parts 71*a* are what is targeted for detection, the output voltage VO becomes the dark voltage Vd=Vd1, Vd2, Vd3, Vd4, respectively; increasing progression of fouling is accompanied by a corresponding decline in the dark voltage Vd (Vd1>Vd2>Vd3>Vd4). The edge of the sheet of paper P then becomes what is targeted for detection by the sheet width sensor 48, and the output voltage Vo is gradually elevated as the amount of the reflected light RL that is accounted for by the paper reflected light increases gradually together with changes in the position x. When the amount of light received by the light-receiving unit 59 reaches a certain constant value, the output voltage Vo reaches the paper voltage Vp (the saturation voltage), and thereafter is held at the paper voltage Vp.

The threshold value VS used by the first detection unit 63 in the first detection processing is set to a value that is higher than the maximum voltage VRmax of the rib waveform VR for when the upstream ribs 73 are detected, as illustrated in the graph in FIG. 10. The position at which the rib waveform VR appears, as is illustrated in FIGS. 8A and 8B, is closer to the home position side, which is the front side of the carriage in the direction of travel, than the position at which the output voltage Vo detects the edge of the sheet of paper P and begins to increase.

While the carriage 18 is in the process of moving in the movement direction X from one outside position in the width direction of the sheet of paper P to the other outside position in the width direction, in a state where the sheet of paper P has been conveyed in the conveyance direction Y to a position where the upstream support surface 71 is covered, the first detection unit 63 compares the output voltage Vo of the sheet width sensor 48 and the threshold value VS, and detects the edge of the sheet of paper P in response to when the output voltage Vo has crossed over the threshold value VS. For any of the graph lines VL1 to V14, the edge of the sheet of paper P (the first edge) is detected in response to when the output voltage Vo, which was a value smaller than the threshold value VS, becomes greater than the threshold value VS. For this reason, the edge of the sheet of paper P is detected without any erroneous detection of the edge of the upstream ribs 73.

Figure 11:
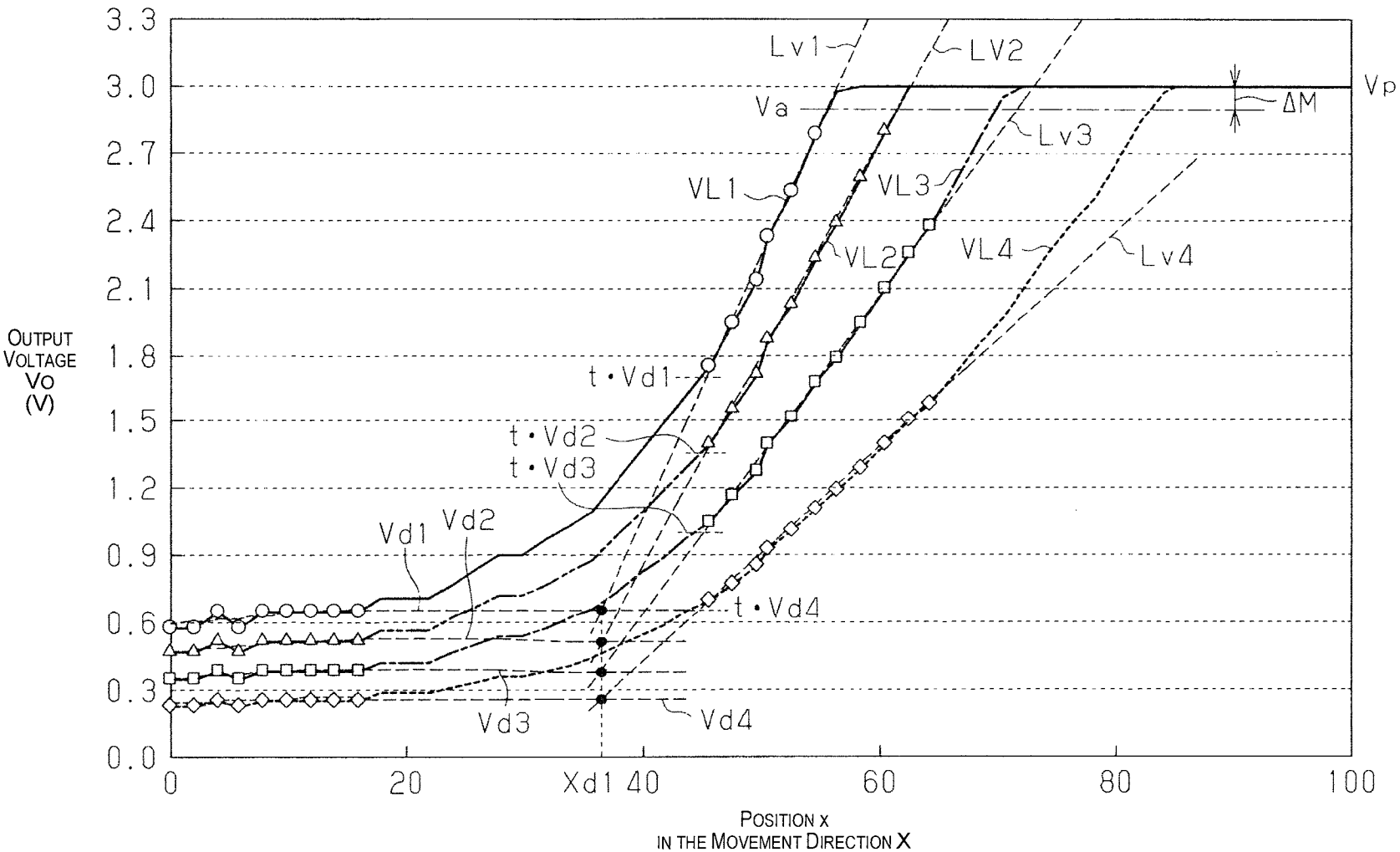
FIG. 11 is a graph illustrating the relationship between an output voltage and a position, for describing a second detection process.

The graph illustrated in FIG. 11 is for describing the second detection processing by the second detection unit 64, and illustrates the relationship between the position x and the output voltage Vo in the movement direction X of the sheet width sensor 48. The position x is indicated in units of 1/600 inch (where 1 inch=25.4 mm), similarly with respect to the graph in FIG. 10. Each of the graph lines VL1 to VL4 illustrates the relationship between the position x and the output voltage Vo at the initial state and then respective stages of progression of fouling, as was described with the graph in FIG. 10.

As will be understood from each of the graph lines VL1 to VL4, the dark voltage Vd (=Vd1, Vd2, Vd3, Vd4) for when the sheet width sensor 48 is at a position x where the groove parts 71*a* are targeted for detection declines in correspondence with the progression of fouling of the sheet width sensor 48 and with the decline in the sensitivity thereof (Vd 1>Vd2>Vd3>Vd4). The first computation unit 65 computes the dark voltage Vd (=Vd1, Vd2, Vd3, Vd4). That is, the first computation unit 65 uses the data group for the position x, the output voltage Vo, and the voltage differential value dVo as stored in succession in the RAM 53 while the carriage 18 is in the process of moving, and reads from the predetermined storage region of the RAM 53 a number N of output voltages Vo where the voltage differential value dVo satisfies $-\delta<dVo<\delta$ (where δ is a very small value close to 0) from among the output voltages Vo of the positions x that correspond to the groove parts 71*a*. The first computation unit 65 calculates the average value of the N output voltages Vo thus read, to acquire the dark voltage Vd (in the examples in FIG. 11, this is Vd1, Vd2, Vd3, Vd4).

After the first detection unit 63 has detected the edge of the sheet of paper P, the second computation unit 66 reads the data group for the position x and the output voltage Vo stored in the predetermined storage of the RAM 53. By acquiring a plurality of coordinate points (x, Vo) at a portion where, out of the portions where the output voltage Vo with respect to the position x is increasing, this increase is at a substantially constant slope in a linear manner, while the light contribution Rp of the reflected light RL gradually increases within the range $0<Rp<1$, and by using the plurality of the coordinate points (x, Vo), the second computation unit 66 computes a linear approximation formula for the linear portion. As illustrated in FIG. 11, for example, in a range where the position x is 20 to 45, the output voltage Vo increases in a curved manner with respect to the position x. In a region where the position x is 45 or greater, within a positional range until when the output voltage Vo reaches a value in the vicinity of the paper voltage Vp, the graph line indicative of the relationship between the position x and the output voltage Vo increases in a linear manner at a substantially constant slope.

Herein, because the reflected light RL is close to a columnar shape, while the paper contribution Rp gradually changes within the range of $0<Rp<1$, when the value of the paper contribution Rp is smaller, the change in the output value Vo is small, despite a change in the position x; as illustrated in FIG. 11, a slow increase begins from the dark voltage Vd1, Vd2, Vd3, Vd4. When the paper contribution Rp reaches a certain extent of magnitude (as one example, when Rp=0.3), the position x and the output voltage Vo thereinafter reach a substantially proportional relationship, and in the region where this proportional relationship holds true, the coordinate points (x, Vo) indicated by the position x and the output voltage Vo are arranged side by side in a substantially linear manner.

In the present embodiment, a saturation voltage is reached before the paper contribution Rp reaches 1 (for example, at Rp=0.8), and the saturation voltage becomes the paper voltage Vp. However, even before the paper voltage Vp is reached, there exists a curved portion where the relationship between the position x and the output voltage Vo falls out from being linear. For this reason, a decision is made to except the coordinate points (x, Vo) that are in the range of a constant margin voltage ΔM, downward from the paper voltage Vp, and these coordinate points are not used to compute the linear approximation formula. Thus, N consecutive coordinate points (x, Vo) that are arranged side by side in a linear manner, in a between portion that excludes the comparatively greater curved portion on the dark voltage Vd side and the comparatively smaller curved portion on the paper voltage Vp side within the range where the output voltage increases from the dark voltage Vd to the paper voltage Vp, are used to compute the linear approximation formula on the basis of a linear approximation method that is known in the art. The in the present example, for example, the least-squares method is employed as the linear approximation method. In the present example, the data group including the N coordinate points (x, Vo) arranged side by side in a linear manner is called "slope data".

The second computation unit 66 calculates t·Vd, found by multiplying the dark voltage Vd by t, and the coordinate points (x, Vo) where the output voltage Vo is less than t·Vd are not employed, being understood to be the curved portion on the dark voltage Vd side. That is, the second computation unit 66 acquires N consecutive coordinate points (x, Vo) where the output voltage Vo is a value t·Vd or greater. Also, in order to avoid the smaller curved portion formed before the paper voltage Vp is reached in the graph lines VL1 to VL4, those coordinate points (x, Vo) of the N coordinate points (x, Vo) where the output voltage Vo is a setting voltage Va (=Vp−ΔM) or greater are excluded. The slope data including the N or fewer plurality of coordinate points (x, Vo) thus obtained is arranged side by side in a substantially linear manner.

Herein, t·Vd refers to an output voltage Vo of when the sheet width sensor 48, irrespective of the sensitivity, is at a position where the paper contribution Rp of the reflected light RL is the same (as one example, a position where Rp=0.3), and is equivalent to an output voltage Vo for a limit where the change in the output voltage Vo with respect to the position x switches from being curved to being linear. The value t is $t>1$, and is set to a value where at least two coordinate points (x, Vo) can be ensured as the slope data, even at the graph line VL1 for when the sheet width sensor 48 is in a high-sensitivity state. In the present embodiment, a value in the range $1\leq t\leq 3$ is employed as one example of the value t. The setting voltage Va can also employ Va=Vcc−s·(Vcc−Vp) (where s is a value satisfying t·Vd<Va<Vp), in a similar manner of thinking to the method switching to Va=Vp−ΔM, using the margin voltage ΔM, and excluding the curved portion therebelow.

In the example of the graph in FIG. 11, six coordinate points (x, Vo) are acquired in the graph line VL1 (the symbol "○" in FIG. 11); nine coordinate points (x, Vo) are acquired in the graph line VL2 (the symbol "Δ" in FIG. 11); eleven coordinate points (x, Vo) are acquired in the graph line VL3 (the symbol "□" in FIG. 11); and eleven coordinate points (x, Vo) are acquired in the graph line VL4 (the symbol "◇" in FIG. 11).

Then, using the N or fewer plurality of coordinate points (x, Vo) acquired with the foregoing conditions, the second computation unit 66 runs a computation based on the least-squares method, and calculates a linear approximation formula Vo=Ax+B. In the example in FIG. 11, the approximation lines Lv1 to Lv4 are determined at the graph lines VL1 to VL4, respectively, of mutually different sensitivities for the sheet width sensor 48. The linear approximation method is not limited to being the least-squares method, and it would also be possible to employ a different linear approximation method that is known in the art.

The edge position computation unit 67 uses the linear approximation formula Vo=Ax+B found by the second computation unit 66 to calculate the position x for when the output voltage Vo is the dark voltage Vd (Vo=Vd) on the approximation lines Lv1 to Lv4, and acquires same as the edge detection position Xd (in the example in FIG. 11, this is Xd1). The edge detection position Xd is calculated by Xd=(Vd−B)/A.

In the example in FIG. 11, the position x for the points of intersection between the approximation lines Lv1 to Lv4 and the horizontal line of Vo=Vd (Vo=Vd1, Vo=Vd2, Vo=Vd3, Vo=Vd4) (the black points in FIG. 11) will be the edge detection position Xd (in FIG. 11, the edge detection position Xd1 of the first edge), whether it be at the initial state or any of the stages of stepwise progression of fouling. Herein, the linear approximation formula indicative of the relationship between the position x and the output voltage Vo corresponding to the change in the paper contribution Rp is relatively more accurately reflective of the sensitivity of the sheet width sensor 48 at that time. For this reason, even when the sensitivity of the sheet width sensor 48 has changed, the edge detection position Xd1 indicated by the position x at each of the points of intersection will be substantially the same position where the paper contribution Rp takes substantially the same value (as one example, Rp=0.2).

Figure 12:
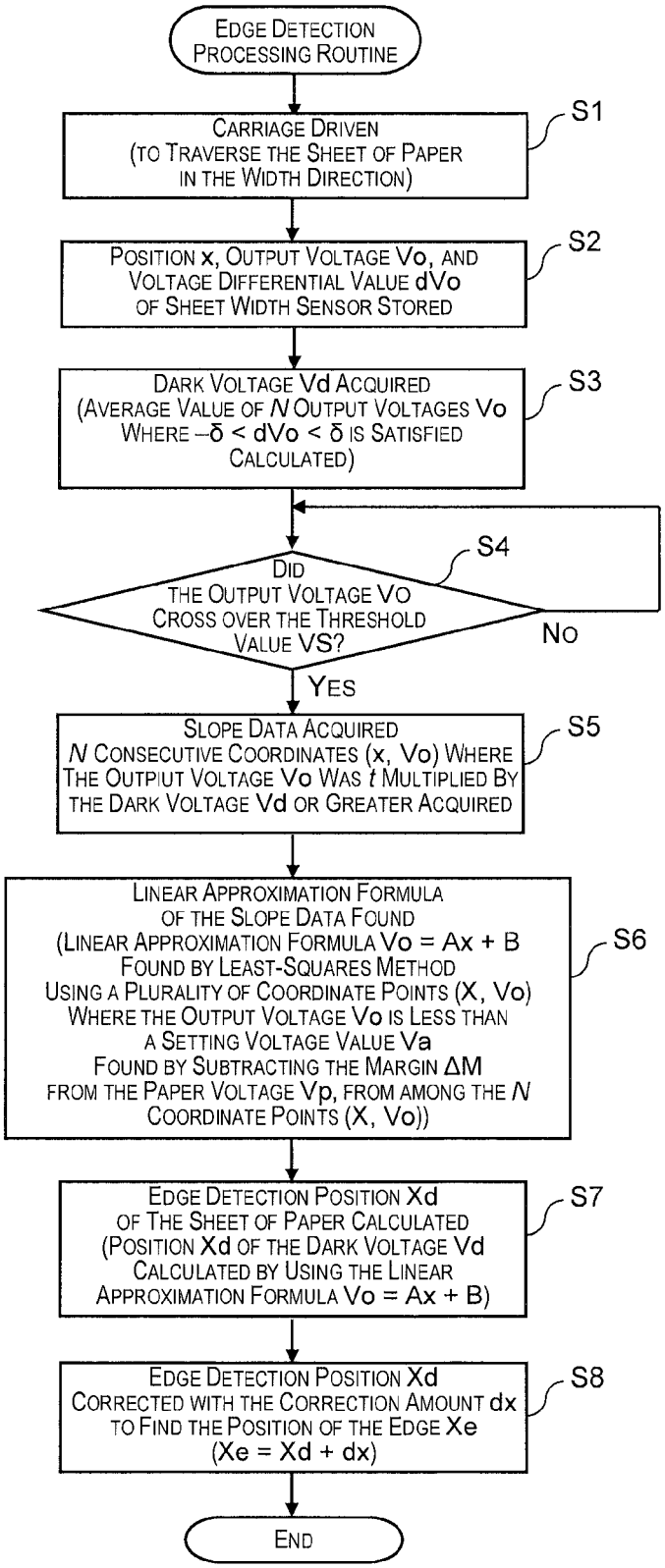
FIG. 12 is a flow chart illustrating an edge detection processing routine.

The following describes the operation of the printer 11 of the present embodiment, in accordance with the flow chart illustrated in FIG. 12. The control unit 50 executes a program for an edge detection processing routine that is illustrated in the flow chart in FIG. 12. When the edge detection processing is being carried out, the control unit 50 drives the conveyance motor 41 and causes the sheet of paper P to be conveyed to the position where the upstream support surface 71 is covered. The control unit 50 initiates the edge detection processing when the sheet of paper P is conveyed to the position where the upstream support surface 71 is covered, or when the sheet of paper has passed through a predetermined position midway during the conveyance thereof and a predetermined timing is reached permitting detection of the first edge of the sheet of paper P by the sheet width sensor 48.

First, in step S1, the carriage 18 is driven and the sheet of paper P is moved so as to traverse the width direction. The control unit 50 drives the carriage motor 35 and moves the carriage 18, located for, for example, the home position side, at a constant speed toward the anti-home position side (S11). At this time, the sheet width sensor 48 receives with the light-receiving unit 59 the reflected light of the light irradiated toward the support base 38 side from the light-emitting unit 58, and outputs to the control unit 50 the output voltage Vo corresponding to the amount of light received thereby.

In the next step S2, the position x, the output voltage Vo, and the voltage differential value dVo of the sheet width sensor 48 are stored. That is, the control unit 50 acquires in succession the position x and the output voltage Vo of the sheet width sensor 48 moving in the movement direction X together with the carriage 18, and stores same in the predetermined storage region of the RAM 53. At this time, the voltage differential value dVo computed by the first computation unit 65 using the position x and the output voltage Vo is stored by the control unit 50 in the predetermined storage region of the RAM 53 in association with the position x and the output voltage Vo. In this manner, the predetermined storage region of the RAM 53 stores in succession the coordinate points (x, Vo) indicated by the position x and the output voltage Vo, and the voltage differential value dVo at each position x, in mutual association. The processing in steps S1 and S2 is executed continuously until the later processing is ended.

, the dark voltage Vd is acquired. That is, the first computation unit 65 reads N output voltages Vo that are at a position x corresponding to the groove parts 71*a* and that satisfy $-\delta<dVo<d$, from the predetermined storage region of the RAM 53, calculates the average value thereof, and acquires same as the dark voltage Vd.

In step S4, a determination is made as to whether or not the output voltage Vo has crossed over the threshold value VS. That is, the first detection unit 63 compares the output voltage Vo and the threshold value VS, and determines whether or not the output voltage Vo has changed from a value smaller than the threshold value VS to a greater value, or whether or not the output voltage Vo has changed from a value greater than the threshold value VS to a smaller value. In a case where the output voltage Vo has not crossed over the threshold value VS, this processing is repeated until the output voltage Vo is determined to have crossed over the threshold value VS. In this example, the first edge of the sheet of paper P is detected earlier than is the second edge, and the output voltage exceeds the threshold value VS from a value therebelow to a value thereabove at the time of the detection of the first edge. When the output voltage is determined to have crossed over the threshold value VS, the flow proceeds to step S5.

In the next step S5, the slope data is acquired. That is, the second computation unit 66 calculates the dark voltage Vd multiplied by t, and reads out from the predetermined storage region of the RAM 53 the number N of consecutive coordinate points (x, Vo) where the output voltage Vo is t·Vd or greater. On, for example, the graph line VL1 during high sensitivity in FIG. 9, N coordinate points (x, Vo) where the output voltage Vo is t·Vd1 or greater (in FIG. 9, these are the points marked with a symbol "○") are acquired; on the graph line VL4 during low sensitivity in FIG. 4, N coordinate points (x, Vo) where the output voltage Vo is t·Vd4 (in FIG. 9, these are the points marked with a symbol "◇") are acquired.

In step S6, a linear approximation formula for the slope data is found. That is, the second computation unit 66 selects a plurality (N or fewer) of coordinate points (x, Vo), from among the N coordinate points (x, Vo), where the output voltage Vo is less than a setting voltage value Va found by subtracting the margin voltage ΔM from the paper voltage Vp, and uses the plurality of coordinate points (x, Vo) to find the linear approximation formula Vo=Ax+B with the least-squares method. On, for example, the graph line VL1 in FIG. 9, a plurality of coordinate points (x, Vo) (for example, six) illustrated in FIG. 9 where the output voltage Vo is a value less than the setting voltage value Va are selected from among the N coordinate points (x, Vo) acquired in step S5, and the plurality of coordinate points (x, Vo) are used to find the linear approximation formula Vo=Ax+B for the approximation line Lv1 with the least-squares method.

In the next step S7 in FIG. 12, the edge detection position Xd of the sheet of paper P is calculated. That is, the edge position computation unit 67 uses the linear approximation formula Vo=Ax+B to calculate, as the edge detection position Xd, the position x for when the output voltage Vo is the dark voltage Vd (Vo=Vd). In, for example, the graph line VL1 in FIG. 9, a coordinate value x for the point where the approximation line Lv1 reaches Vo=Vd1 (the black point in FIG. 11) is calculated as the edge detection position Xd. At this time, as will be understood from FIG. 11, the edge detection position Xd for when the paper contribution Rp of the reflected light RL reaches 0.1, as one example, is calculated, even when the sensitivity of the sheet width sensor 48 is different.

In the next step S8 in FIG. 12, the edge detection position Xd is corrected with the correction amount dx to acquire the edge position Xe. That is, the edge position correction unit 62 determines whether the edge targeted for positional detection is the first edge or the second edge, from the value of the edge detection position Xd, and consults the correction data CD (FIG. 9) to acquire the correction amount dx corresponding to the edge of the side thus determined. The edge position correction unit 62 determines, for example, that the edge detection position Xd is the first edge when it is closer to the home position (a smaller value) than the widthwise center position of the conveyance route, and determines that the edge detection position Xd is the second edge when it is closer to the anti-home position (a greater value). In this example, the edge position correction unit 62 first determines that the edge detection position is the first edge, and thus consults the correction data CD and acquires the correction amount dx1 that corresponds to the first edge. The edge position correction unit 62 then calculates the first edge position Xe1 by adding the correction amount dx1 to the edge detection position Xd1 (Xe1=Xd1+dx1).

When the detection of the edge position Xe1 of the first edge is thus ended, the control unit 50 subsequently carries out the processing of steps S4 to S8, and carries out the position detection processing for the second edge. First, the first detection unit 63 detects the second edge in response to when the output voltage Vo changes from a value above the threshold value VS to a value therebelow (S4). Then, upon detection of the second edge, the second computation unit 66 of the second detection unit 64 calculates the dark voltage Vd multiplied by t (where t>1), reads from the predetermined storage region of the RAM 53 the number N of consecutive coordinate points (x, Vo) where the output voltage Vo is t·Vd or greater, and acquires same as the slope data for the second edge (S5). The edge position computation unit 67 selects a plurality (N or fewer) of coordinate points (x, Vo) where the output voltage Vo is less than the setting voltage value Va (=Vp−ΔM), from among the N coordinate points (x, Vo), and uses the plurality of coordinate points (x, Vo) to find the linear approximation formula Vo=Ax+B of the slope data with the least-squares method (S6). Next, the edge position computation unit 67 uses the linear approximation formula Vo=Ax+B to calculate the position x where Vo=Vd as the edge detection position Xd2 (S7). The edge position correction unit 62 corrects the edge detection position Xd2 with the correction amount dx 2 corresponding to the second edge, acquired by consulting the correction data CD, and acquires the edge position Xe2 (=Xd2+dx2) (S8).

As has been described above, according to the first embodiment, the effects presented below can be obtained.

(1) The dark voltage Vd is acquired, and the slope data including the plurality of coordinate points (x, Vo) is used to compute the linear approximation formula Vo=Ax+B with the least-squares method. Then, the linear approximation formula Vo=Ax+B is used to calculate the position x where Vo=Vd, as the edge detection position Xd. Accordingly, the edge detection position Xd of the sheet of paper P can be detected with relatively greater accuracy, even when fouling of the sheet width sensor 48 or the like has caused a change in the sensitivity thereof.

(2), Because the linear approximation formula Vo=Ax+B is employed as the approximation function, the computation processing for the second computation unit 66 and the edge position computation unit 67 can be relatively easily done. When, for example, the approximation function is a curved function, there is a concern that a curved approximation formula where the plurality of coordinate points (x, Vo) neatly sit on the approximation curve might not be found, and that there might be low detection accuracy with an edge detection position that is found by using such a curved approximation formula which is not so accurately reflective of the sensitivity of the sheet width sensor 48. However, in the present embodiment, the portion where the change in the output voltage of the Vo with respect to the position x is linear is selected and the plurality of coordinate points (x, Vo) at the linear portion are used to find the linear approximation formula, and thus it is easier to acquire an approximation formula on which the plurality of coordinate points (x, Vo) neatly sit. The slope of the linear portion is also comparatively more accurately reflective of the sensitivity of the sheet width sensor 48. As a result, the use of the linear approximation formula makes it possible to acquire a more highly accurate edge detection position Xd.

(3) By acquiring the N consecutive coordinate points (x, Vo) where the output voltage Vo is a value t·Vd or greater, the second computation unit 66 excludes the coordinate points of a region of curvature on the dark voltage Vd side from the coordinate points (x, Vo) that are used in computing the linear approximation formula. Also, by employing the plurality (N or fewer) of coordinate points (x, Vo) where the output voltage Vo is a value less than the setting voltage Va (=Vp−ΔM), from among the plurality of coordinate points (x, Vo), the second computation unit 66 excludes the coordinate points of a small region of curvature on the paper voltage Vp side. Accordingly, it is possible to acquire as the slope data the plurality of coordinate points (x, Vo) that are arranged side by side in a linear manner, so that the output voltage Vo with respect to the position x increases or lowers at a substantially constant slope. The second computation unit 66 then computes the linear approximation formula Vo=Ax+B on the basis of the plurality of coordinate points (x, Vo). The linear approximation formula Vo=Ax+B is comparatively more accurately reflective of the sensitivity of the sheet width sensor 48 at the time, and it is possible to comparatively more accurately detect the edge detection position Xd on the basis of the linear approximation formula Vo=Ax+B and the dark voltage Vd (the dark output value).

(4) When the linear approximation formula Vo=Ax+B is used to calculate the edge detection position Xd, a method is employed where the position x where Vo=Vd is calculated as the edge detection position Xd. Accordingly, the edge detection position Xd can be found with a comparatively easier computation.

(5) The position x and the output voltage Vo of the sheet width sensor 48 when the groove parts 71*a* are targeted for detection are acquired, and the voltage differential value dVo is calculated. A plurality (N) of output voltages Vo corresponding to the position x for when the voltage differential value dVo is within a setting range (−δ<dVo<δ) are acquired, and the average value of the plurality of output voltages Vo serves as the dark voltage Vd. Accordingly, the dark voltage Vd can be acquired as a comparatively more accurate value.

(6) The dark voltage Vd is acquired while the carriage 18 is in the process of moving during the edge detection processing, and thus there is no need to carry out a carriage movement operation intended to acquire the dark voltage Vd separately from the edge detection processing. Because the frequency of movement of the carriage 18 that is unrelated to printing can be reduced, this leads, for example, to an enhancement in the print throughput of the printer 11.

(7) An edge detection position Xd where the amount of deviation from the actual edge position of the sheet of paper P is substantially constant and is small can be acquired, irrespective of any differences in the sensitivity caused by fouling of the sheet width sensor 48 or the like. Accordingly, the correction amount dx used in the calculation of the edge position Xe from the edge detection position Xd can be a constant value, and thus the processing for calculating the edge detection position Xe can be rendered comparatively easier. For example, a case adopting a configuration where the correction amount dx is altered in accordance with the sensitivity, which varies depending on the extent of fouling of the sheet width sensor 48, would necessitate configurations for a sensitivity measurement unit that would measure the sensitivity of the sheet width sensor, a correction amount acquisition unit that would find a correction amount corresponding to the sensitivity, and the like. However, in the present embodiment, because the correction amount dx is a constant value, it is relatively easy to calculate the edge position Xe from the edge detection position Xd.

(8) The first detection unit 63 detects the edge of the sheet of paper P while also avoiding erroneous detection of the upstream ribs 73 (protrusions) by comparing the output voltage Vo and the threshold value VS, and when the edge of the sheet of paper P is detected by the first detection unit 63, the edge detection position Xd of that edge is next detected by the second detection unit 64. For this reason, it is possible to acquire the edge detection position Xd of the sheet of paper P even when the rib waveform VR appears in the output voltage Vo of the sheet width sensor 48, without the edge of the upstream ribs 73 being erroneously detected as being the edge of the sheet of paper P. At this time, because the threshold value VS is a value that is greater than the maximum voltage VRmax of the rib waveform VR and less than the paper voltage Vp, it is possible to reliably avoid erroneous detection of the edge of the upstream ribs 73.

Second Embodiment

The second embodiment shall now be described on the basis of FIG. 13. The present embodiment is an example where the edge position Xe is detected by a different method than in the first embodiment. The electrical configuration of the printer 11 and the functional configuration of the control unit 50 are similar to those of the first embodiment. The non-volatile memory 54 stores an edge detection processing program illustrated by the flow chart in FIG. 14, instead of the edge detection processing program illustrated by the flow chart in FIG. 12.

Figure 13:
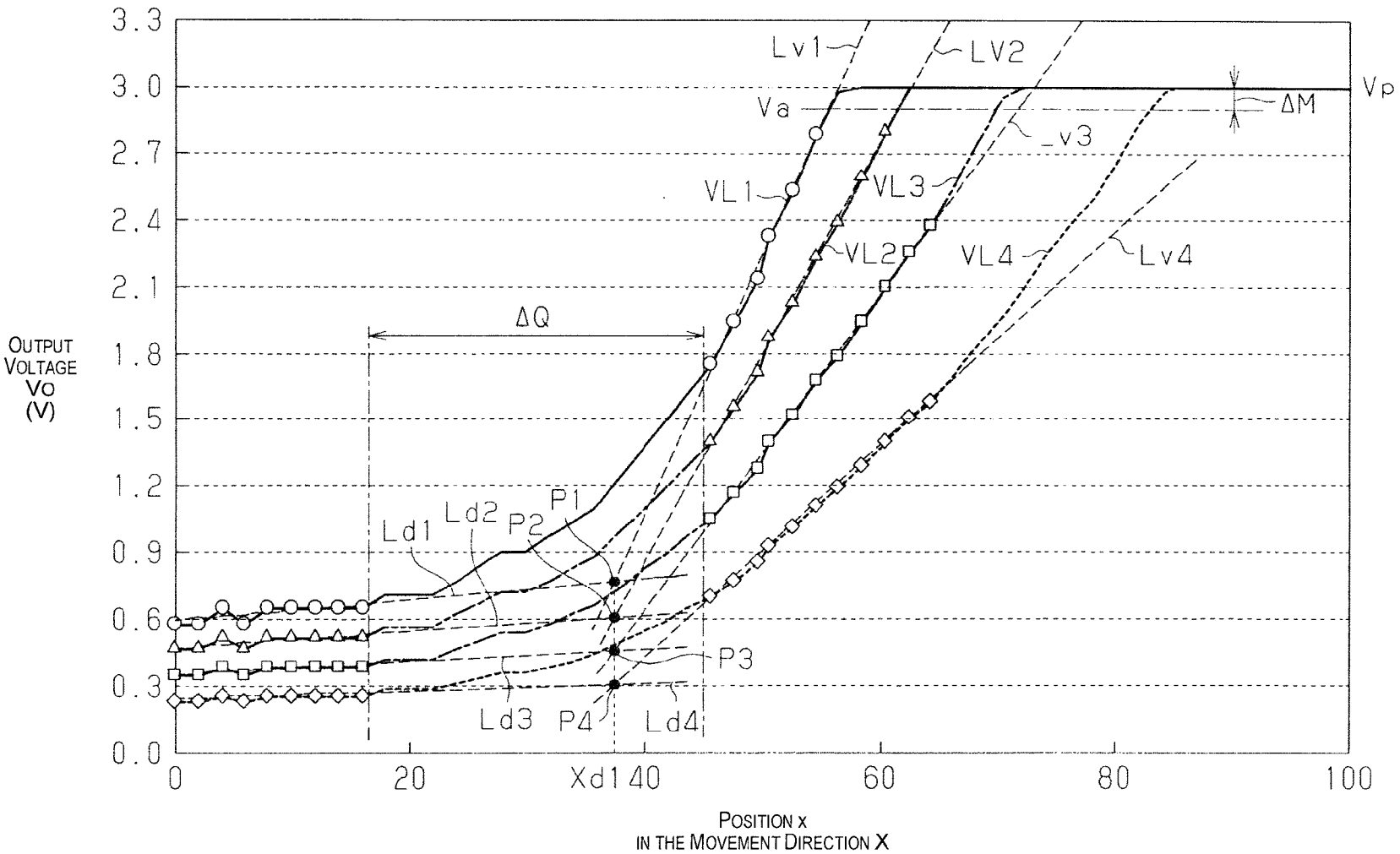
FIG. 13 is a graph illustrating the relationship between an output voltage and a position, for describing a second detection process in a second embodiment.
Figure 14:
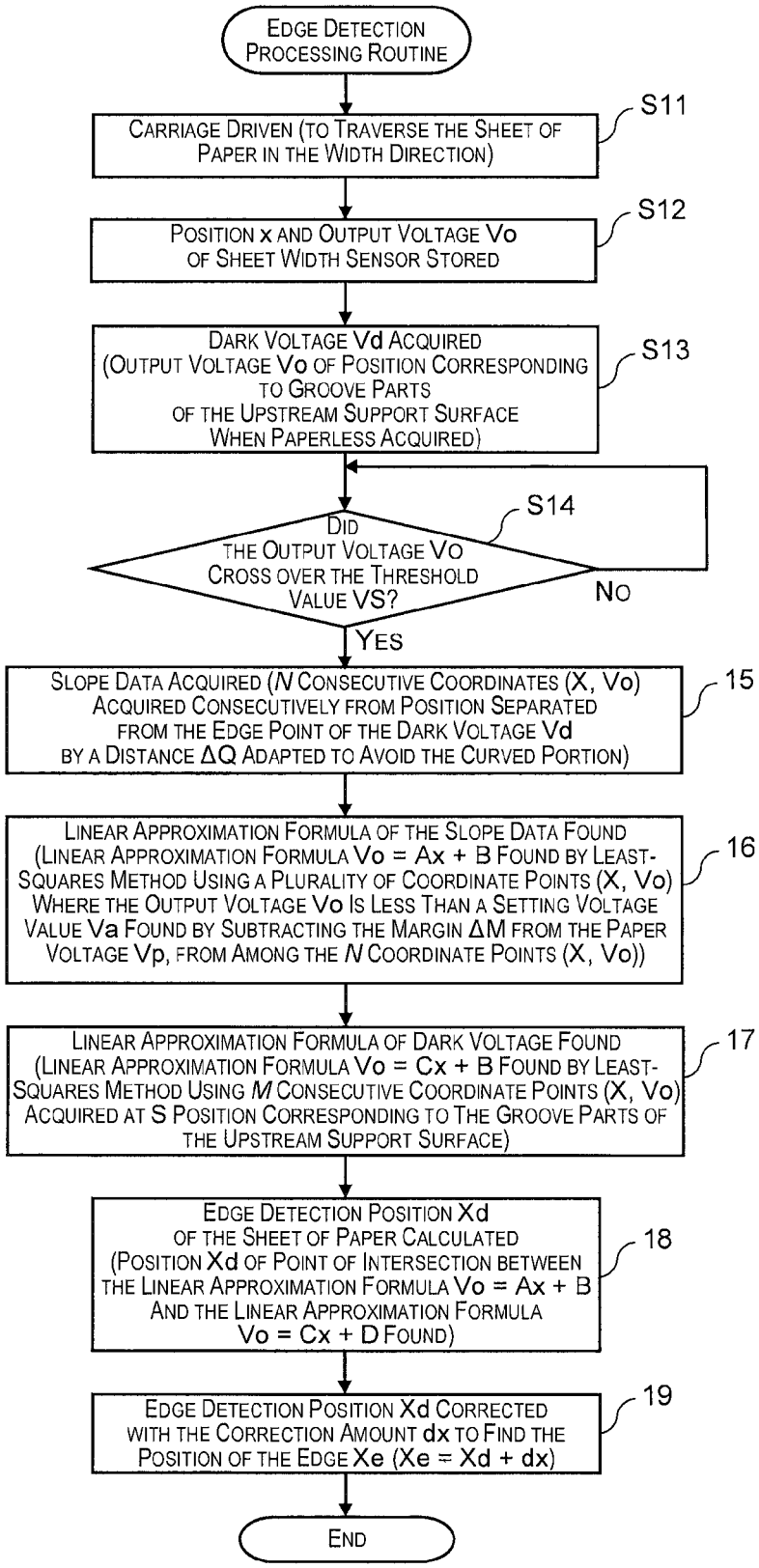
FIG. 14 is identically a flow chart illustrating an edge detection processing routine.

The following describes the edge detection processing in the present embodiment, with reference to FIG. 13, on the basis of FIG. 14. When the edge detection processing is being carried out, the control unit 50 drives the conveyance motor 41 and causes the sheet of paper P to be conveyed to the position where the upstream support surface 71 is covered. The control unit 50 initiates the edge detection processing when the sheet of paper P is conveyed to the position where the upstream support surface 71 is covered, or when a predetermined timing is reached at which the sheet of paper P has passed through a predetermined position midway in the conveyance thereof.

Firstly, the processing for step S11 is similar processing to that of step S1 in the first embodiment. That is, the control unit 50 drives the carriage motor 35, and causes the carriage 18 to be moved at a constant speed so as to cross the sheet of paper P in the width direction, for example, from the home position side toward the anti-home position side (S11). At this time, the output voltage Vo corresponding to the amount of light received by the sheet width sensor 48 is outputted to the control unit 50.

In the next step S2, the position x and the output voltage Vo of the sheet width sensor 48 are stored. That is, the control unit 50 acquires in succession the position x and the output voltage Vo of the sheet width sensor 48 moving in the movement direction X of the carriage 18, and stores same in the predetermined storage region of the RAM 53. The processing of these steps S11 and S12 is executed continuously until the later processing is ended.

In step S13, the dark voltage Vd is acquired. That is, the first computation unit 65 acquires as the dark voltage Vd the output voltage Vo at the position x corresponding to the groove parts 71*a* of the upstream support surface 71 when, while the carriage 18 is in the process of moving, the target of detection by the sheet width sensor 48 is not the paper (when the sheet width sensor 48 is at an area not covered by the sheet of paper P). For example, the position x and the output voltage Vo are used to calculate the voltage differential value dVo, and a maximum M coordinate points (x, Vo) where the voltage differential value dVo satisfies $-\delta<dVo<\delta$ are acquired on the front side from the position where $-\delta<dVo<\delta$ is no longer satisfied; the maximum M coordinate points are stored in the predetermined storage region of the RAM 53. In the present embodiment, the maximum M of coordinate points (x, Vo) are equivalent to the dark output value.

In step S14, a determination is made as to whether or not the output voltage Vo has crossed over the threshold value VS. That is, the first detection unit 63 runs processing that is similar to step S4 in the first embodiment. For example, when it is determined that the first edge of the sheet of paper P is detected and that the output voltage Vo has crossed over the threshold value VS, the flow proceeds to step S15.

In the next step S15, the slope data is acquired. That is, the second computation unit 66 reads from the predetermined storage region of the RAM 53 a number N of coordinate points (x, Vo) continuously from a position separated from the edge point of the dark voltage Vd by a distance ΔQ, adapted to avoid a curved portion (the region of curvature). As illustrated in FIG. 13, of the plurality (M or fewer) of coordinate points (x, Vo) where the output voltage Vo takes the value of the dark voltage Vd, the portion of the distance ΔQ in the movement direction from the edge point located foremost on the sheet of paper P side (the right-end point in FIG. 13) is excluded from the slope data, as a curved portion. For this reason, N coordinate points (x, Vo) are acquired continuously from a position x that is separated by the distance ΔQ in the movement direction from the edge point of the dark voltage Vd.

In the next step S16 in FIG. 14, the linear approximation formula of the slope data is found. That is, the second computation unit 66 runs processing similar to step S16 in the first embodiment, and uses the plurality (N or fewer) of coordinate points (x, Vo) where the output voltage Vo is a value less than the setting voltage value Va (=Vp−ΔM), from among the N coordinate points (x, Vo), to find the linear approximation formula Vo=Ax+B with the least-squares method. Accordingly, a linear approximation formula indicative of the approximation lines Lv1 to Lv4 in FIG. 13 is found, in accordance with the sensitivity of the sheet width sensor 48 at that time.

In the next step S17, the linear approximation formula of the dark voltage is found. That is, by using the maximum M of coordinate points (x, Vo) that are at a position corresponding to the groove parts 71*a* of the upstream support surface 71 and were acquired on front side of the position where $-\delta<dVo<\delta$ was no longer satisfied, the first computation unit 65 finds a linear approximation formula Vo=Cx+D with the least-squares method. Accordingly, a linear approximation formula indicative of the approximation lines Ld1 to Ld4 for the dark voltage Vd in FIG. 13 are found, in accordance with the sensitivity of the sheet width sensor 48 at that time. In the present embodiment, the linear approximation formula Vo=Ax+B for the slope data is equivalent to one example of a first linear approximation formula, and the linear approximation formula Vo=Cx+D for the dark voltage is equivalent to one example of a second linear approximation formula.

In the next step S18, the edge detection position of the sheet of paper P is calculated. That is, the edge position computation unit 67 calculates the x coordinate of the point of intersection between the linear approximation formula Vo=Ax+B and the linear approximation formula Vo=Cx+D, and this coordinate serves as the edge detection position Xd. At this time, the point of intersection P1 to P4 has substantially the same value for the x coordinate, irrespective of any difference in the sensitivity of the sheet width sensor 48 at that time, as illustrated by the graph in FIG. 13, and an edge detection position Xd of substantially the same position in the movement direction X is calculated.

In the next step S19, the edge position Xe is acquired by correcting the edge detection position Xd with the correction amount dx. That is, the edge position correction unit 62 determines whether the edge targeted for positional detection is the first edge or the second edge, from the value of the edge detection position Xd, and consults the correction data CD (FIG. 9) to acquire the correction amount dx corresponding to the edge of the side thus determined. In this example, the edge position correction unit 62 first determines that the edge detection position is the first edge, and consults the correction data CD to acquire the correction amount dx1 that corresponds to the first edge. The edge position correction unit 62 then calculates the first edge position Xe1 by adding the correction amount dx1 to the edge detection position Xd1 (Xe1=Xd1+dx1).

When the detection of the edge position Xe1 of the first edge is ended in this manner, the control unit 50 subsequently carries out the processing for steps S14 to S19, and carries out the position detection processing for the second edge. Firstly, the first detection unit 63 detects the second edge in response to when the output voltage Vo changes from a value above the threshold value VS to a value therebelow (S14). When, when the second edge is detected, the second computation unit 66 of the second detection unit 64 reads out from the predetermined storage region of the RAM 53 the number N of coordinate points (x, Vo) consecutively from a position that is separated from the edge point of dark voltage Vd toward the sheet of paper P side by the distance ΔQ adapted for avoiding the curved portion, and the slope data of the second edge is acquired (S15). Further, the second computation unit 66 selects a plurality (N or fewer) of coordinate points (x, Vo) where the output voltage Vo is less than the setting voltage Va (=Vp−ΔM) from among the N coordinate points (x, Vo), and uses the plurality of coordinate points (x, Vo) to find the linear approximation formula Vo=Ax+B for the slope data with the least-squares method (S16). By using a maximum M of output voltages that are at a position corresponding to the groove parts 71*a* of the upstream support surface 71 and were acquired consecutively at the front side from a position where −δ<dVo<δ is no longer satisfied (on an anti-paper side), the first computation unit 65 finds the linear approximation formula Vo=Cx+D for the dark voltage with the least-squares method (S17).

Also, the edge position computation unit 67 calculates as the edge detection position Xd1 of the second edge a position x of the point of intersection between the linear approximation formula Vo=Ax+B for the slope data and the linear approximation formula Vo=Cx+D for the dark voltage Vd (S18). The edge position correction unit 62 then corrects the edge detection position Xd2 with the correction amount dx2 for the second edge, acquired by consulting the correction data CD, and acquires the edge position Xe2 (=Xd2+dx2) (S19).

According to the second embodiment, the effect presented below is obtained, in addition to similar effects to the effects (2) and (6) to (8) in the first embodiment.

(9) The position x of the point of intersection of the linear approximation formula Vo=Ax+B of the slope data and the linear approximation formula Vo=Cx+D of the dark voltage Vd is calculated as the edge detection position Xd of the sheet of paper P. At this time, the linear approximation formula Vo=Ax+B is comparatively more accurately reflective of the sensitivity of the sheet width sensor 48, and thus the edge position Xe can be detected with comparatively greater accuracy, irrespective of any difference in the sensitivity caused by fouling of the sheet width sensor 48 or the like. Also, by using the linear approximation formula of the dark voltage Vd, it is easier for a more accurate edge detection position Xd to be detected when the dark voltage Vd changes at a given gradual slope. Because the configuration is one where N consecutive coordinate points (x, Vo) are acquired from a position separated from the end point of the dark voltage Vd by the distance ΔQ, there is no need to compute t·Vd, as was executed in the first embodiment, and the slope data can be acquired with simpler processing in comparison to the first embodiment.

The embodiments described above can also be altered to the following modes. The edge detection position Xd can be acquired by combining the method of the first embodiment and the method of the second embodiment. For example, an error condition for the edge detection position Xd is set in each of the methods, and an error determination based on each respective error condition of the edge detection positions Xd calculated in each of the methods is carried out; in a case where one is determined to have an error, the other edge detection position Xd is employed. Instead of the error determination, the method can also be one where a determination condition for determining which has a higher accuracy is set, and the one determined to be of higher accuracy is employed as the edge detection position Xd. Also, it would be possible to employ a method where the average value of the edge detection position calculated in each of the methods is calculated, and serves as the edge detection position Xd.

Implementation can switch between the processing for acquiring the slope data and finding the linear approximation formula thereof in the first embodiment (S5, S6) and the processing for acquiring the slope data and finding the linear approximation formula thereof in the second embodiment (S15, S16).

Rather than carrying out the processing for acquiring the dark voltage Vd in each of the embodiments (S3, S13) during the edge detection processing routine, the processing can be carried out in advance, as processing that is separate from the edge detection processing routine. For example, it would be possible to employ a configuration for executing dark voltage acquisition processing, as one part of the initial processing implemented when the printer 11 is powered on (started up). It would also be possible to employ a configuration in which the dark voltage acquisition processing is executed every time the cumulative number of printed sheets counted by the control unit 50 reaches a setting number of sheets (a setting value). The dark voltage acquisition processing can also be executed at both such execution timings. In the dark voltage acquisition processing, the position x, the output voltage Vo, and the like for when the carriage 18 is moved and is at a position where the sheet width sensor 48 targets the groove parts 71*a* for detection are acquired, and the processing in step S3 or S13 is carried out on the basis of the position x, the output voltage Vo, and the like, to acquire the dark voltage Vd. Accordingly, the frequency of movement of the carriage 18 intended to acquire the dark voltage Vd can be correspondingly reduced, and, for example, the throughput of the printer 11 can be enhanced.

The embodiments employed a first-order approximation formula in which the point group of the coordinate points (x, Vo) for the dark voltage or the slope data was approximated as an approximation function, but a curved approximation formula, such as a second-order approximation formula or a third-order approximation formula, can also be employed. In the case of a curved approximation formula, the position x of the point of intersection between the approximation function and the dark voltage Vd is found. The position x at this point of intersection is the position where the paper contribution Rp for the reflected light RL is switched from 0 to a positive value. The edge detection position Xd should be corrected using as the correction amount dx the direction in the width direction from this position until when, for example, the optical axis of the sheet width sensor 48 is located at an edge of the sheet of paper P in the movement direction X (an edge position) and where the paper contribution reaches Rp=0.5.

The cross-sectional shape of the light emitted from the light-emitting unit 58 is not limited to being circular. For example, the cross-sectional shape of the light can be rectangular (quadrangular), so that the rate of change in the paper contribution Rp with respect to the rate of change in the position x is constant. In the case of such a configuration, the curved portion (region of curvature) in FIGS. 11 and 13 and the like is less likely to occur, and it is possible to obviate the need for the condition for avoiding the curved portion (for example, $Vo \geq t \cdot Vd$ (first embodiment, or the distance $\Delta Q$ condition (second embodiment)), and the approximation function can be comparatively more easily computed.

The correction processing by the edge position correction unit 62 can be eliminated. For example, in a case where the amount of positional deviation caused by errors in the assembly of the carriage 18 and the support base 38 or the like in the printer 11 is within an allowable error range and where the positional accuracy is ensured, even when the edge detection position Xd is used without modification, then the correction processing by the edge position correction unit 62 can be forgone and the edge detection position Xd can be employed as the edge position Xe.

The configuration can also be one in which the edge detection processing is executed only when the edge on a side where the ribs are located further forward than the edge of the sheet of paper in the carriage movement direction during edge detection processing (in each of the embodiments, the first edge) is detected, and in which the edge position of the sheet of paper is detected, without carrying out detection processing using a threshold value, when the edge on the side where the edge of the sheet of paper is located further forward than the ribs (protrusions) in the carriage movement direction.

A support base having no ribs (protrusions) can be employed, with the first detection unit 63 then being eliminated. For example, in a case where a planar support base is employed, the surface of the support base, not covered with the sheet of paper P, will serve as the dark region.

The carriage movement direction during the edge detection processing can be the direction going from the anti-home position side toward the home position side. The method of moving the carriage 18 can also be one in which the carriage 18, which was arranged above the sheet of paper, is moved to one side in the movement direction X (the width direction) and one edge of the sheet of paper is detected, following which the carriage 18 is moved in the opposing direction and the other edge of the sheet of paper is detected.

The reflecting surface for acquiring the dark voltage is not limited to being the groove parts 71*a*, and can be altered as appropriate. For example, the reflecting surface can be the bottom surface of recesses that are deeper than the groove parts. The reflecting surface can also be a light-absorbent surface obtained when a light-absorbent layer provided to a predetermined position in the upstream support surface 71 of the support base is formed on the surface. Also, the reflecting surface serving as the dark region need not be below a position through which the carriage 18 passes during printing, but rather can be arranged at a position that is on the outside of the liquid ejecting region PA in the movement direction X.

The optical sensor for detecting the widthwise edge position of the medium is not limited to being a sheet width sensor the purpose of which is to acquire the sheet width or is to determine an ejection start position (print start position) in the movement direction X (main scanning direction) of the liquid ejecting head 19. For example, the optical sensor can be intended merely to acquire the edge position in the width direction of the medium. The purpose can also be to detect the skew (slant) of the medium.

The detection circuitry of the sheet width sensor 48 was a circuitry configuration where the output voltage Vo is higher when the amount of light received by the light-receiving unit 59 is greater and where the output voltage Vo is lower when the amount of light received is lower, but, conversely thereto, it would also be possible to employ a circuitry configuration where the output voltage Vo is lower when the amount of light received by the light-receiving unit 59 is greater and the output voltage Vo is higher when the amount of light received is lower. In such a case, even with a circuitry configuration where the output voltage Vo is lower when the amount of light received by the light-receiving unit 59 is greater, fundamentally the same processing is carried out, merely by vertically inverting the graphs in FIGS. 11, 13 and the like, making it possible to detect the edge detection position Xd by using the linear approximation formula for the slope data and the dark voltage Vd.

Each of the functional units inside the control unit 50 (computer) in FIGS. 3A and 3B is achieved primarily with software by a CPU that executes programs, but, for example, each of the functional units can also be achieved with hardware by an integrated circuit, or can be achieved by cooperation between software and hardware.

The liquid ejecting apparatus is not limited to being a printer, but rather can also be a multifunction peripheral provided with a plurality of functions in addition to a printer function, such as a scanner function and a copy function.

The printer (print apparatus) is not limited to being a serial printer, and can instead be a lateral printer, a line printer, or a page printer. In the case of, for example, a fixed configuration where the liquid ejecting head 19 fundamentally does not move, such as a line printer or a page printer, then there will be a small-sized carriage for moving the optical sensor, the configuration being one where the optical sensor is provided to this small-sized carriage. In other words, the liquid ejecting head is not provided to the carriage, and the optical sensor is provided to the carriage. A proper edge detection position can still be detected even in such a case of a line printer or page printer.

The medium is not limited to being a sheet of paper, but rather can also be a resin film, a metal foil, a metal film, a composite film of resin and metal (a laminate film), a textile, a non-woven fabric, a ceramic sheet, or the like. Further, the shape of the medium is not limited to being a sheet, but can rather be a three-dimensional shape.

In the embodiments described above, the invention was embodied in an inkjet printer, which is one type of liquid ejecting apparatus, but there is no limitation to printers in cases where the invention is applied to a liquid ejecting apparatus. For example, the invention can also be embodied in a liquid ejecting apparatus for ejecting or discharging a different liquid other than ink (including a fluid body such as a liquid body or gel that is formed by dispersing or mixing particles of a functional material into a liquid). For example, the invention can be a liquid ejecting apparatus for ejecting a liquid body that includes, in a dispersed or dissolved form, a material such as a colorant (a pixel material) or an electrode material used, inter alia, to produce liquid crystal displays, electroluminescence (EL) displays, or surface emitting displays. The invention can further be a liquid ejecting apparatus for ejecting bio-organic matter used in the production of biochips, or a liquid ejecting apparatus for ejecting a liquid serving as a test sample, used as a precision pipette. Furthermore, the invention can be: a liquid ejecting apparatus for ejecting onto a substrate a translucent resin solution, such as a thermosetting resin, for forming, inter alia, a hemispherical micro lens (optical lens) used in an optical communication element or the like; a liquid ejecting apparatus for ejecting an etching solution, such as an acid or an alkali, to etch a substrate or the like; or a fluid ejecting apparatus for ejecting a fluid such as a gel (for example, a physical gel) or the like. The invention can be applied to any of these types of liquid ejecting apparatuses. In this manner, the medium (recording medium) can also be a substrate on which an element, wiring, or the like is to be formed by etching. The "liquid" ejected by the liquid ejecting apparatus encompasses liquids (including inorganic solvents, organic solvents, solutions, liquid resins, liquid metals (metal melts), and the like), liquid bodies, fluid bodies, and so forth.

What is claimed is:

1. A liquid ejecting apparatus, comprising:

a liquid ejecting head for ejecting a liquid toward a medium;

a light reflection optical sensor which is provided to a carriage that moves reciprocatingly in a movement direction that intersects a conveyance direction of the medium, which has a light-emitting unit and a light-receiving unit, and which outputs an output value corresponding to an amount of light received by the light-receiving unit;

a dark output value acquisition unit for acquiring a dark output value corresponding to the amount of light received by the light-receiving unit when at a position where the optical sensor targets for detection a dark region provided so that the amount of light received by the light-receiving unit receiving reflected light of light irradiated by the light-emitting unit is less than that of the medium;

an approximation function acquisition unit for acquiring a plurality of coordinate points indicated by the position and the output value of a portion where the output value increases or decreases with respect to the change in position when the optical sensor, which moves in the movement direction, is within a range of positions where an edge of the medium is targeted for detection, in a state where the medium has been conveyed to a position where detection by the optical sensor is possible, and for computing an approximation function on the basis of the plurality of coordinate points; and an edge position detection unit for detecting the edge position of the medium on the basis of the approximation function and the dark output value, the dark output value acquisition unit and the approximation function acquisition unit sequentially acquires the dark output value and the plurality of coordinate points, respectively, while the carriage progressively moving only in a single direction along the movement direction.

2. The liquid ejecting apparatus as set forth in claim 1, wherein the approximation function acquisition unit computes a linear approximation formula as the approximation function.

3. The liquid ejecting apparatus as set forth in claim 2, wherein the approximation function acquisition unit selects the plurality of coordinate points, the coordinate points being arranged side by side in a linear manner, from among the coordinate points at the portion where the output value increases or decreases with respect to the change in the position, and computes the linear approximation formula on the basis of the plurality of coordinate points.

4. The liquid ejecting apparatus as set forth in claim 2, wherein in a case where the linear approximation formula is a first linear approximation formula, the dark output value acquisition unit acquires a plurality of coordinate points indicated by the position and the output value of when the optical sensor is at a position where the dark region is targeted for detection, and computes a second linear approximation formula on the basis of the plurality of coordinate points, and the edge position detection unit computes as the edge position the position of a point of intersection between the first linear approximation formula and the second linear approximation formula.

5. The liquid ejecting apparatus as set forth in claim 1, wherein the dark output value acquisition unit acquires the dark output value on the basis of the output value of the light-receiving unit for when the optical sensor, at a position where the medium is not targeted for detection, detects the dark region and targets the dark region for detection, while the carriage is in the process of being moved in the movement direction for the purpose of detecting the edge position of the medium.

6. The liquid ejecting apparatus as set forth in claim 1, wherein the liquid ejecting apparatus is provided with a control unit for causing the carriage to be moved in the movement direction at a timing where the liquid ejecting apparatus is powered on and/or at a timing where the cumulative number of media that have undergone liquid ejecting processing by the liquid ejecting head reaches a setting value, and the dark output value acquisition unit acquires the dark output value on the basis of the output value for when the optical sensor is at a position where the dark region is targeted for detection while the carriage is in the process of being moved in the movement direction.

7. The liquid ejecting apparatus as set forth in claim 1, wherein the liquid ejecting apparatus further includes a support unit having a plurality of protrusions for supporting the medium, and a first detection unit for detecting the edge of the medium by comparing a threshold value at which the medium can be detected and the protrusions cannot be detected and an output value of the optical sensor, which moves in the movement direction, in a state where the medium has been conveyed to a position at which detection by the optical sensor is possible;

and when the edge of the medium is detected by the first detection unit, the edge position is next detected by a second detection unit, which includes the approximation function acquisition unit, the dark output value acquisition unit, and the edge position detection unit.

8. The liquid ejecting apparatus as set forth in claim 1, wherein the dark output value acquisition unit acquires a plurality of dark output values corresponding to the amount of light received by the light-receiving unit, with the plurality of dark output values being sequentially acquired while the carriage moving over the dark region in the movement direction, and the edge position detection unit detects the edge position of the medium on the basis of the approximation function and the plurality of dark output values.

9. A method for detecting a medium edge position in a liquid ejecting apparatus, in which an edge position of a medium in a movement direction is detected on the basis of a position and an output value of a light reflection optical sensor which is provided to a carriage that moves in the movement direction, intersecting with a conveyance direction of the medium, and which has a light-emitting unit and a light-receiving unit, the method comprising:

acquiring a dark output value corresponding to the amount of light received by the light-receiving unit when at a position where the optical sensor targets for detection a dark region provided so that the amount of light received by the light-receiving unit receiving reflected light from the light irradiated by the light-emitting unit is less than that of the medium;

acquiring a plurality of coordinate points in a portion where the output value increases or decreases with respect to the position in a range of positions where the optical sensor, which moves in the movement direction, targets the edge of the medium for detection, in a state where the medium has been conveyed to a position at which detection by the optical sensor is possible, and for computing an approximation function on the basis of the plurality of coordinate points; and detecting the edge position of the medium on the basis of the approximation function and the dark output value, the acquiring of the dark output value and the acquiring of the plurality of coordinate points include sequentially acquiring the dark output value and the plurality of coordinate points, respectively, while the carriage progressively moving only in a single direction along the movement direction.

10. The method as set forth in claim 9, wherein the acquiring of the dark output value includes acquiring a plurality of dark output values corresponding to the amount of light received by the light-receiving unit, with the plurality of dark output values being sequentially acquired while the carriage moving over the dark region in the movement direction, and the detecting of the edge position of the medium includes detecting the edge position of the medium on the basis of the approximation function and the plurality of dark output values.

* * * * *